US011971030B2

(12) United States Patent
Lee et al.

(10) Patent No.: US 11,971,030 B2
(45) Date of Patent: Apr. 30, 2024

(54) SCROLL COMPRESSOR

(71) Applicant: Hanon Systems, Daejeon (KR)

(72) Inventors: Kyung Jae Lee, Daejeon (KR); Jeong Ki Seo, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 146 days.

(21) Appl. No.: 17/596,716

(22) PCT Filed: Jun. 23, 2020

(86) PCT No.: PCT/KR2020/008185

§ 371 (c)(1),
(2) Date: Dec. 16, 2021

(87) PCT Pub. No.: WO2021/015429

PCT Pub. Date: Jan. 28, 2021

(65) Prior Publication Data

US 2022/0316475 A1 Oct. 6, 2022

(30) Foreign Application Priority Data

Jul. 24, 2019 (KR) ..... 10-2019-0089760

(51) Int. Cl.
*F04C 18/02* (2006.01)

(52) U.S. Cl.
CPC ..... *F04C 18/0215* (2013.01); *F04C 2240/30* (2013.01); *F04C 2240/60* (2013.01)

(58) Field of Classification Search
CPC .... F04C 18/0215; F04C 23/008; F04C 29/12; F04C 2240/30; F04C 18/0261; F04C 29/128
See application file for complete search history.

(56) References Cited

FOREIGN PATENT DOCUMENTS

| | | | |
|---|---|---|---|
| CN | 101165350 | A | 4/2008 |
| CN | 203248362 | U | 10/2013 |
| CN | 103486027 | A | 1/2014 |
| JP | H0412183 | A | 1/1992 |
| JP | H04370383 | A | 12/1992 |
| JP | H09105386 | A | 4/1997 |
| JP | H10259788 | A | 9/1998 |

(Continued)

OTHER PUBLICATIONS

KR-20100017008-A English Machine Translation (Year: 2010).*
JP-2018053827-A English Machine Translation (Year: 2018).*

*Primary Examiner* — Anthony Ayala Delgado
(74) *Attorney, Agent, or Firm* — Shumaker, Loop & Kendrick, LLP; James D. Miller

(57) ABSTRACT

A scroll compressor includes a housing; a motor provided in the housing; a rotating shaft rotated by the motor; an orbital scroll orbital moved by the rotating shaft; and a fixed scroll forming a compression chamber together with the orbital scroll, wherein the fixed scroll includes an injection hole guiding an intermediate pressure refrigerant to the compression chamber, wherein the compression chamber is formed in a pair, and wherein the injection hole is formed to communicate with any one of the pair of compression chambers when communicating with the other one of the pair of compression chambers. Thereby, an amount of refrigerant discharged from the compression chamber is increased, and thus the performance and efficiency of the compressor may be improved.

12 Claims, 23 Drawing Sheets

(56) References Cited

FOREIGN PATENT DOCUMENTS

| | | | | | |
|---|---|---|---|---|---|
| JP | 2012180838 | A | | 9/2012 | |
| JP | 2012184750 | A | | 9/2012 | |
| JP | 2013227873 | A | | 11/2013 | |
| JP | 2016079885 | A | | 5/2016 | |
| JP | 2016109033 | A | | 6/2016 | |
| JP | 6186973 | B2 | | 8/2017 | |
| JP | 2018053827 | A | | 4/2018 | |
| JP | 2018053827 | A | * | 4/2018 | ..... F04C 18/0215 |
| KR | 100504889 | B1 | | 7/2005 | |
| KR | 20100017008 | A | * | 2/2010 | |
| KR | 101921833 | B1 | | 11/2018 | |
| WO | 2011013199 | A | | 2/2011 | |
| WO | 2011013199 | A1 | | 2/2011 | |

* cited by examiner

SCROLL COMPRESSOR

CROSS-REFERENCE TO RELATED PATENT APPLICATIONS

This patent application is a United States nation phase patent application based on PCT/KR2020/008185 filed on Jun. 23, 2020, which claims the benefit of Korean Patent Application No. 10 2019 0089760 filed on Jul. 24, 2019, the entire disclosures of which are hereby incorporated herein by reference.

TECHNICAL FIELD

The present disclosure relates to a scroll compressor, and more particularly, to a scroll compressor capable of compressing a refrigerant with a fixed scroll and an orbital scroll.

BACKGROUND ART

In general, an air conditioning device (A/C) for heating and cooling an interior is installed in a vehicle. The air conditioning device is a component of a cooling system, and includes a compressor compressing a low-temperature and low-pressure gaseous refrigerant introduced from an evaporator into a high-temperature and high-pressure gaseous refrigerant and sending it to a condenser.

The compressor includes a reciprocating type compressing a refrigerant through a reciprocating motion of a piston, and a rotary type performing compression while rotating. According to a power transmission method, the reciprocating type includes a crank type transmitting power to a plurality of pistons using a crank, a swash plate type transmitting power to a rotating shaft on which a swash plate installed, and the like, and wherein the rotary type includes a vane rotary type using a rotating rotary shaft and vanes, and a scroll type using orbital scroll and fixed scroll.

A scroll compressor is widely used for refrigerant compression in air conditioning devices due to its advantages of obtaining a relatively high compression ratio compared to other types of compressors and obtaining a stable torque through smooth refrigerant suction, compression and discharge strokes.

FIG. 1 is a cross-sectional view showing a conventional scroll compressor.

Referring to FIG. 1, a conventional scroll compressor includes a housing 100, a motor 200 provided in the housing 100, a rotating shaft 300 rotated by the motor 200, an orbital scroll 400 orbital moved by the rotating shaft 300, and a fixed scroll 500 forming a compression chamber C with the orbital scroll 400.

In the conventional scroll compressor according to this configuration, when power is applied to the motor 200, the rotating shaft 300 rotates together with a rotor of the motor 200, and the orbital scroll 400 is orbital moved by the rotating shaft 300 and, the refrigerant is sucked into the compression chamber C, compressed in the compression chamber C, and discharged from the compression chamber C by the orbital movement of the orbital scroll 400.

However, in the conventional scroll compressor, an amount of refrigerant discharged from the compression chamber C is determined, and there is a limit in improving the performance and efficiency of the compressor.

SUMMARY

Accordingly, an object of the present disclosure is to provide a scroll compressor capable of improving the performance and efficiency of the compressor by increasing an amount of refrigerant discharged from a compression chamber.

In order to achieve the object as described above, the present disclosure provides a scroll compressor including a housing; a motor provided in the housing; a rotating shaft rotated by the motor; an orbital scroll orbital moved by the rotating shaft; and a fixed scroll forming a compression chamber together with the orbital scroll, wherein the fixed scroll includes an injection hole guiding an intermediate pressure refrigerant to the compression chamber, wherein the compression chamber is formed in a pair, and wherein the injection hole is formed to communicate with any one of the pair of compression chambers when communicating with the other one of the pair of compression chambers.

The injection hole may be formed to be blocked from one of the pair of compression chambers when blocked from the other one of the pair of compression chambers.

The compression chamber may include a first compression chamber having a first pressure, a second compression chamber having a second pressure higher than the first pressure, and a third compression chamber having a third pressure higher than the second pressure.

The first compression chamber may include a first outer compression chamber formed by an outer circumferential surface of an orbiting wrap of the orbital scroll and an inner circumferential surface of a fixed wrap of the fixed scroll, and a first inner compression chamber formed by an inner circumferential surface of the orbiting wrap and an outer circumferential surface of the fixed wrap, the second compression chamber may include a second outer compression chamber formed by the outer circumferential surface of the orbiting wrap and the inner circumferential surface of the fixed wrap, and a second inner compression chamber formed by the inner circumferential surface of the orbiting wrap and the outer circumferential surface of the fixed wrap, and the third compression chamber may include a third outer compression chamber formed by the outer circumferential surface of the orbiting wrap and the inner circumferential surface of the fixed wrap, and a third inner compression chamber formed by the inner circumferential surface of the orbiting wrap and the outer circumferential surface of the fixed wrap.

The injection hole may include a first injection hole communicating with the first outer compression chamber, and a second injection hole communicating with the first inner compression chamber, and communication between the second injection hole and the first inner compression chamber may be initiated when communication between the first injection hole and the first outer compression chamber is initiated, and the communication between the second injection hole and the first inner compression chamber may be terminated when the communication between the first injection hole and the first outer compression chamber is terminated.

The fixed scroll may include a main discharge hole discharging the refrigerant of the third compression chamber, and a sub discharge hole discharging the refrigerant of the second compression chamber, the sub discharge hole may include a first sub discharge hole discharging the refrigerant of the second outer compression chamber, and a second sub discharge hole discharging the refrigerant of the second inner compression chamber, and communication between the second sub discharge hole and the second inner compression chamber may be initiated when communication between the first sub discharge hole and the second outer compression chamber is initiated, and the communication between the second sub discharge hole and the second inner compression chamber may be terminated when the communication between the first sub discharge hole and the second outer compression chamber is terminated.

The first sub discharge hole and the second sub discharge hole may be formed on opposite sides with respect to the main discharge hole, and the first injection hole and the second injection hole may be formed on opposite sides with respect to an imaginary line connecting the first sub discharge hole and the second sub discharge hole.

In addition, the present disclosure provides a scroll compressor including a housing; a motor provided in the housing; a rotating shaft rotated by the motor; an orbital scroll orbital moved by the rotating shaft; and a fixed scroll forming a pair of compression chambers with the orbital scroll, wherein the fixed scroll includes an injection hole guiding intermediate pressure refrigerant into the pair of compression chambers, a main discharge hole discharging the refrigerant compressed in the pair of compression chambers, a first sub discharge hole discharging the refrigerant overcompressed in any one of the pair of compression chambers, and a second sub discharge hole discharging the refrigerant overcompressed in the other one of the pair of compression chambers, and a discharge valve including a main opening/closing portion opening and closing the main discharge hole, a first sub opening/closing portion opening and closing the first sub discharge hole, a second sub opening/closing portion opening and closing the second sub discharge hole, a fastening portion fastened to the fixed scroll, a main supporting portion extending from the main opening/closing portion to the fastening portion, a first sub supporting portion extending from the first sub opening/closing portion to the fastening portion, and a second sub supporting portion extending from the second sub opening/closing portion to the fastening portion is formed in the fixed scroll.

A width of the fastening portion may be formed to be smaller than a distance between the first sub opening/closing portion and the second sub opening/closing portion.

The fixed scroll may include a fixed wrap entry connected to a fixed wrap of the fixed scroll on an outer periphery of the fixed scroll, and a fastening member fastening the fastening portion to the fixed scroll may be fastened to the fixed wrap entry.

At least one of the first sub supporting portion and the second sub supporting portion may include an avoidance portion engraved toward the main supporting portion so as not to interfere with the injection hole.

The scroll compressor may further include an injection flow path guiding intermediate pressure refrigerant from an outside of the housing to the injection hole, and an injection valve assembly opening and closing the injection flow path, wherein the injection valve assembly may include a protrusion protruding toward the fixed scroll, and wherein an outlet communicating with the injection hole may be formed on the protrusion.

The protrusion may include a large-diameter portion protruding from the injection valve assembly toward the fixed scroll and having a predetermined first outer diameter, and a small-diameter portion protruding further from the large-diameter portion toward the fixed scroll and having a second outer diameter smaller than the first outer diameter.

The fixed scroll may include a fixed base plate upper surface opposite to the large-diameter portion, a fixed base plate lower surface forming a rear surface of the fixed base plate upper surface, a small-diameter portion insertion groove formed to be engraved from the fixed base plate upper surface toward the fixed base plate lower surface and into which the small-diameter portion is inserted, and the injection hole formed to be engraved from the fixed base plate lower surface toward the fixed base plate upper surface and communicated with the small-diameter portion insertion groove.

An inner diameter of the small-diameter portion insertion groove may be larger than an inner diameter of the injection hole.

The scroll compressor according to the present disclosure includes a housing; a motor provided in the housing; a rotating shaft rotated by the motor; an orbital scroll orbital moved by the rotating shaft; and a fixed scroll forming a compression chamber together with the orbital scroll, wherein the fixed scroll includes an injection hole guiding an intermediate pressure refrigerant to the compression chamber, wherein the compression chamber is formed in a pair, and wherein the injection hole is formed to communicate with any one of the pair of compression chambers when communicating with the other one of the pair of compression chambers, thereby increasing an amount of refrigerant discharged from the compression chamber, and improving the performance and efficiency of the compressor.

DETAILED DESCRIPTION OF AN EMBODIMENT

Hereinafter, a scroll compressor according to the present disclosure will be described in detail with reference to the accompanying drawings.

Figure 1:
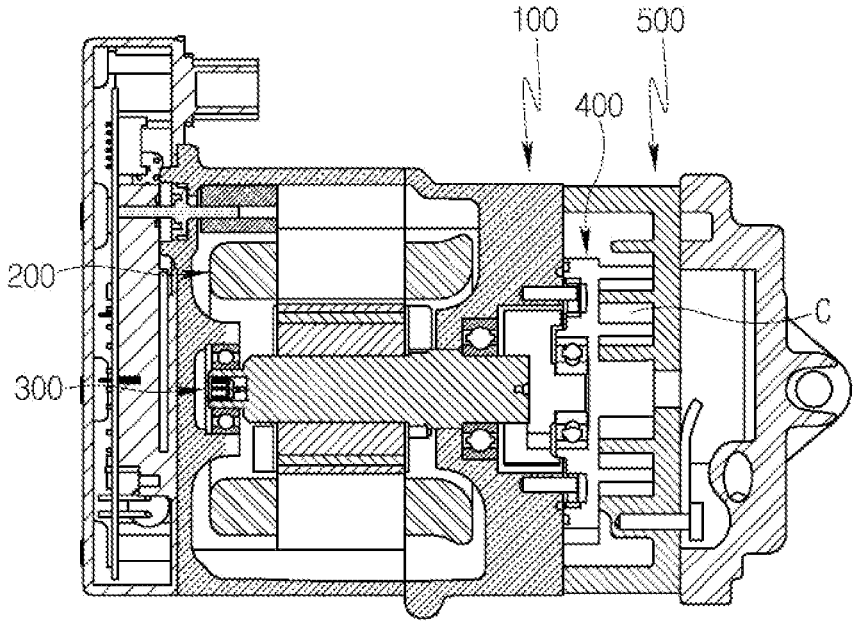
Fig. 1 Prior Art
FIG. 1 is a cross-sectional view showing a conventional scroll compressor.
Figure 2:
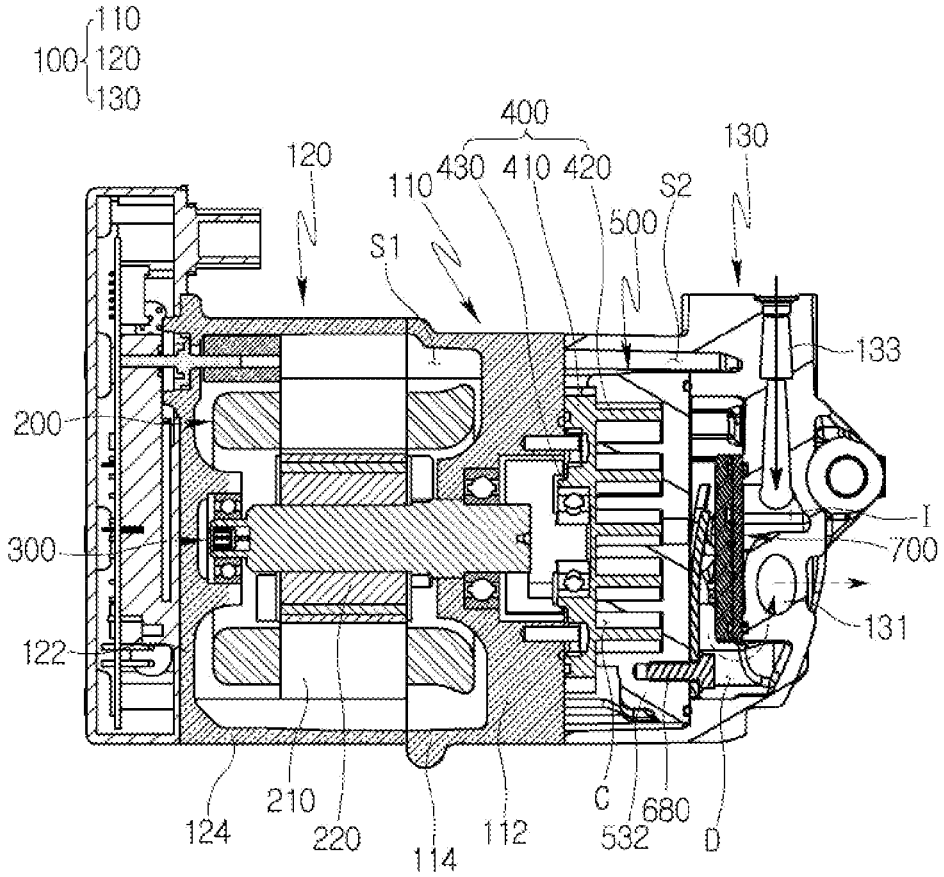
FIG. 2 is a cross-sectional view showing a scroll compressor according to an embodiment of the present disclosure.
Figure 3:
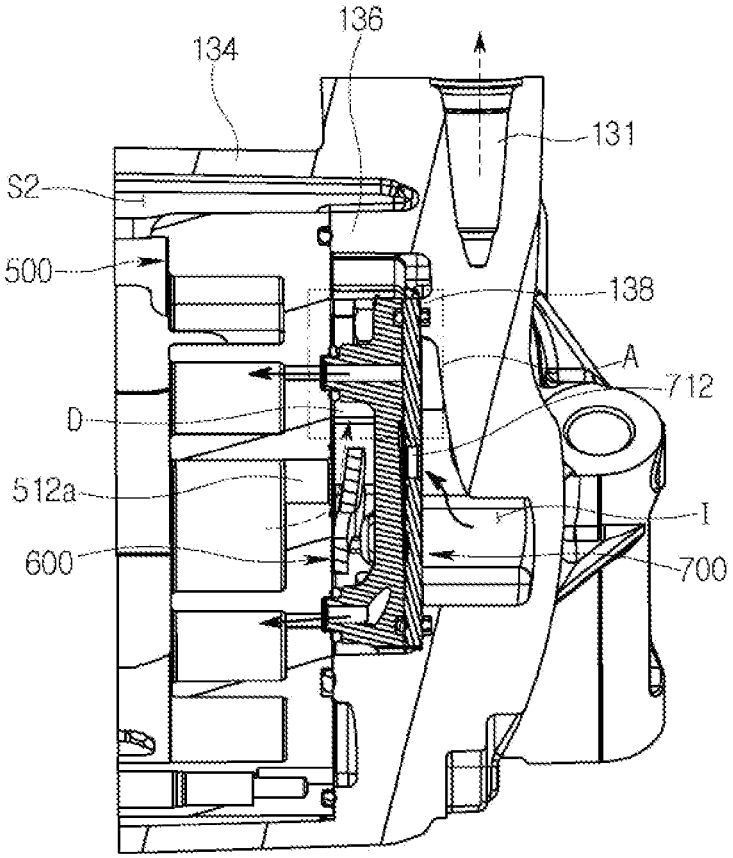
FIG. 3 is a cross-sectional view showing a rear housing side of the scroll compressor of FIG. 2 from another direction.
Figure 4:
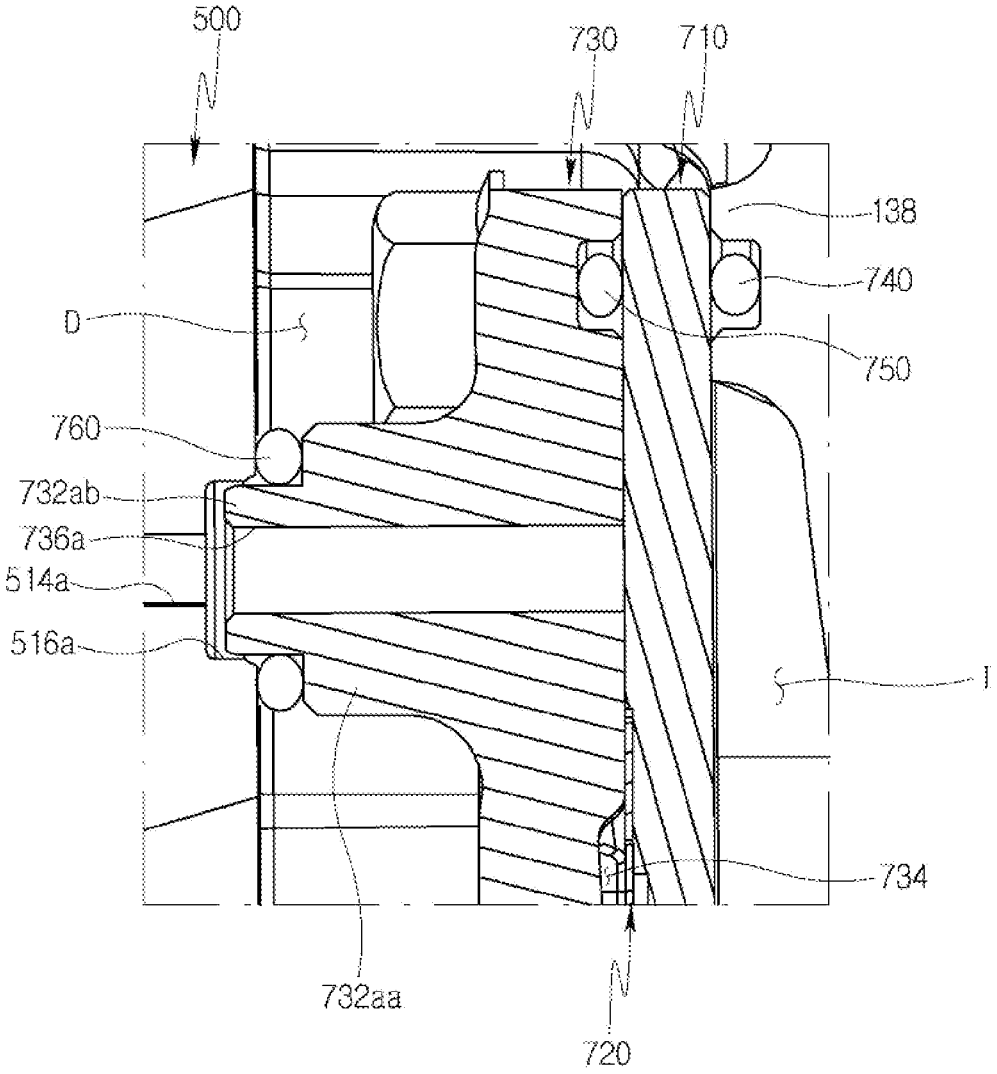
FIG. 4 is an enlarged cross-sectional view of part A of FIG. 3.
Figure 5:
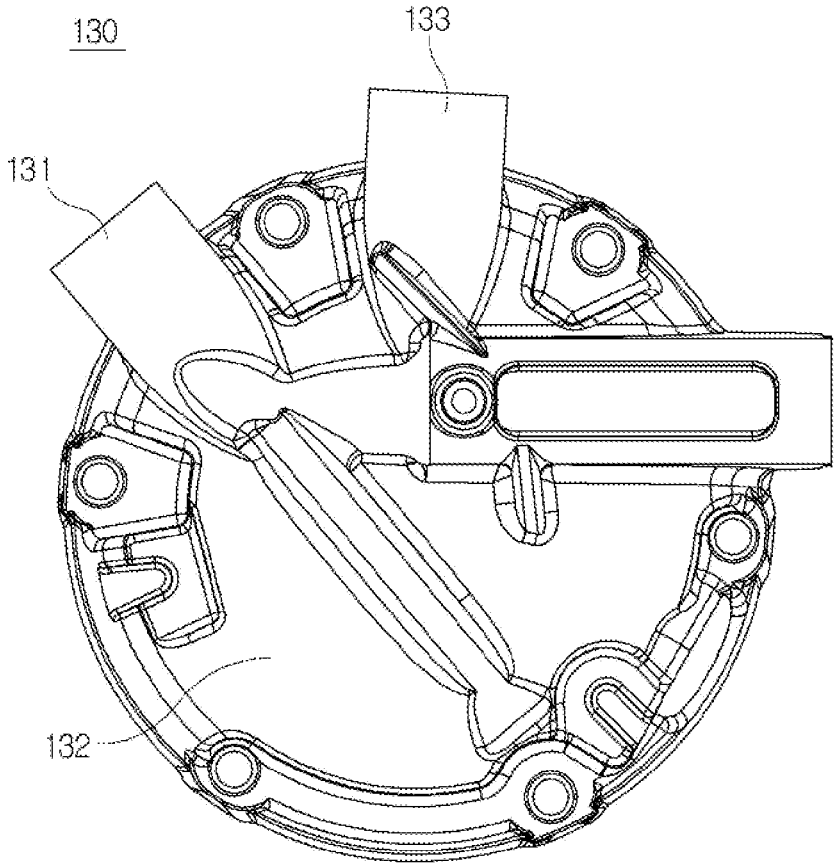
FIG. 5 is a front view showing a rear housing of the scroll compressor of FIG. 2.
Figure 6:
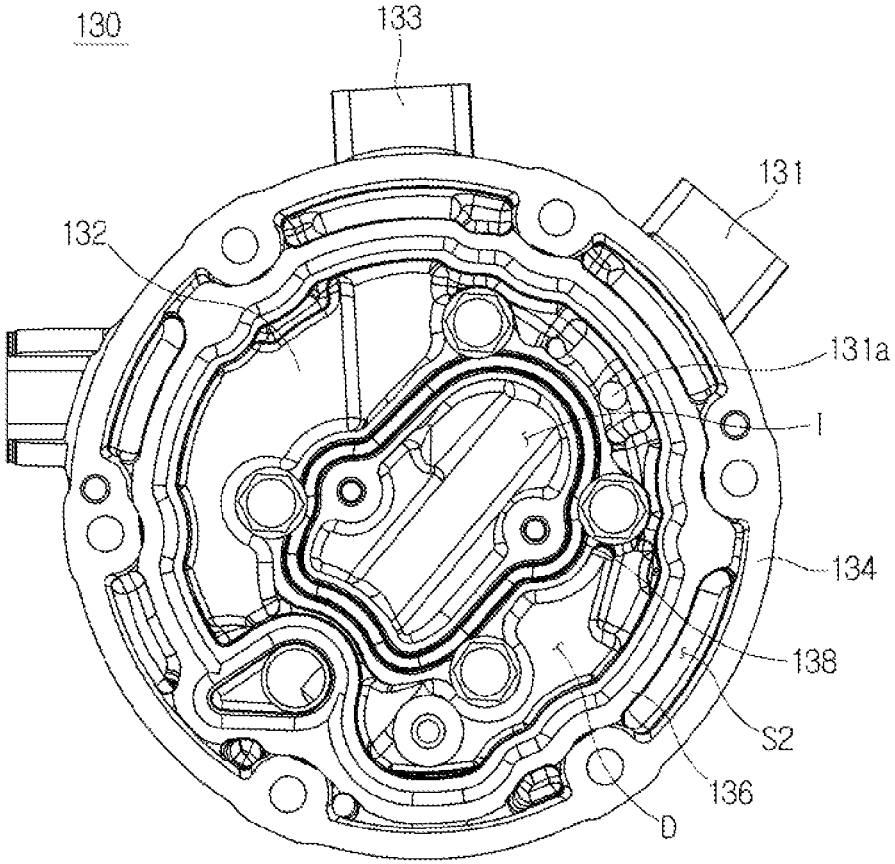
FIG. 6 is a rear view of FIG. 5.
Figure 7:
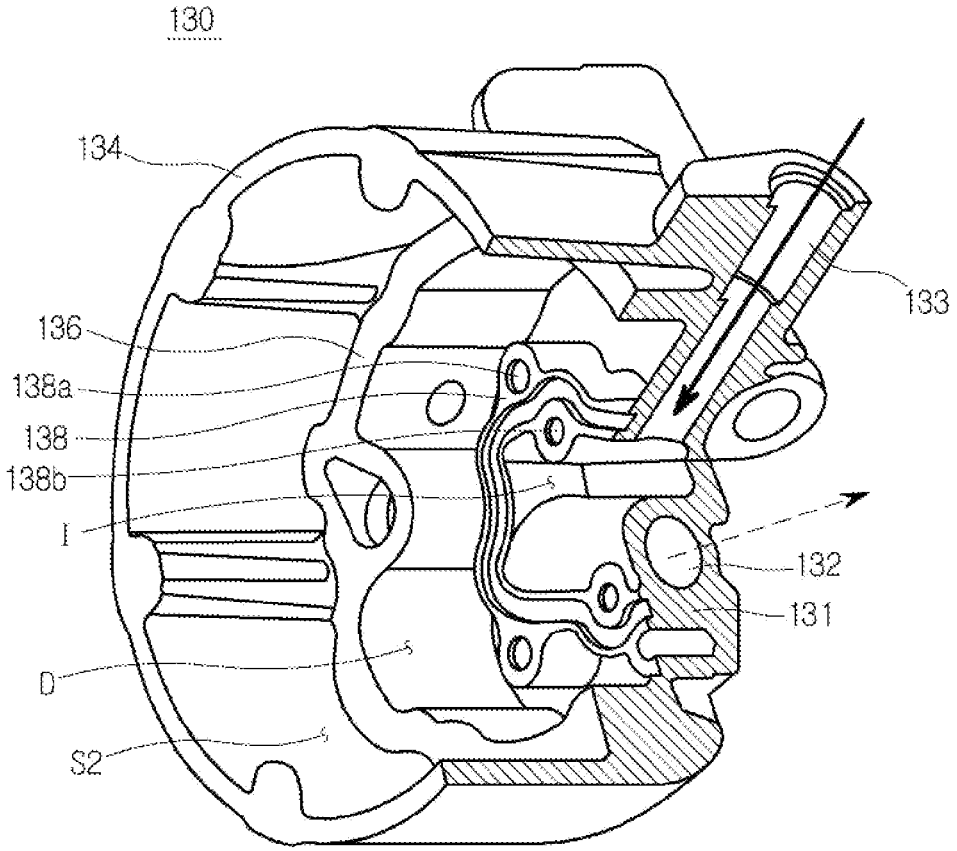
FIG. 7 is a perspective view of FIG. 6.
Figure 8:
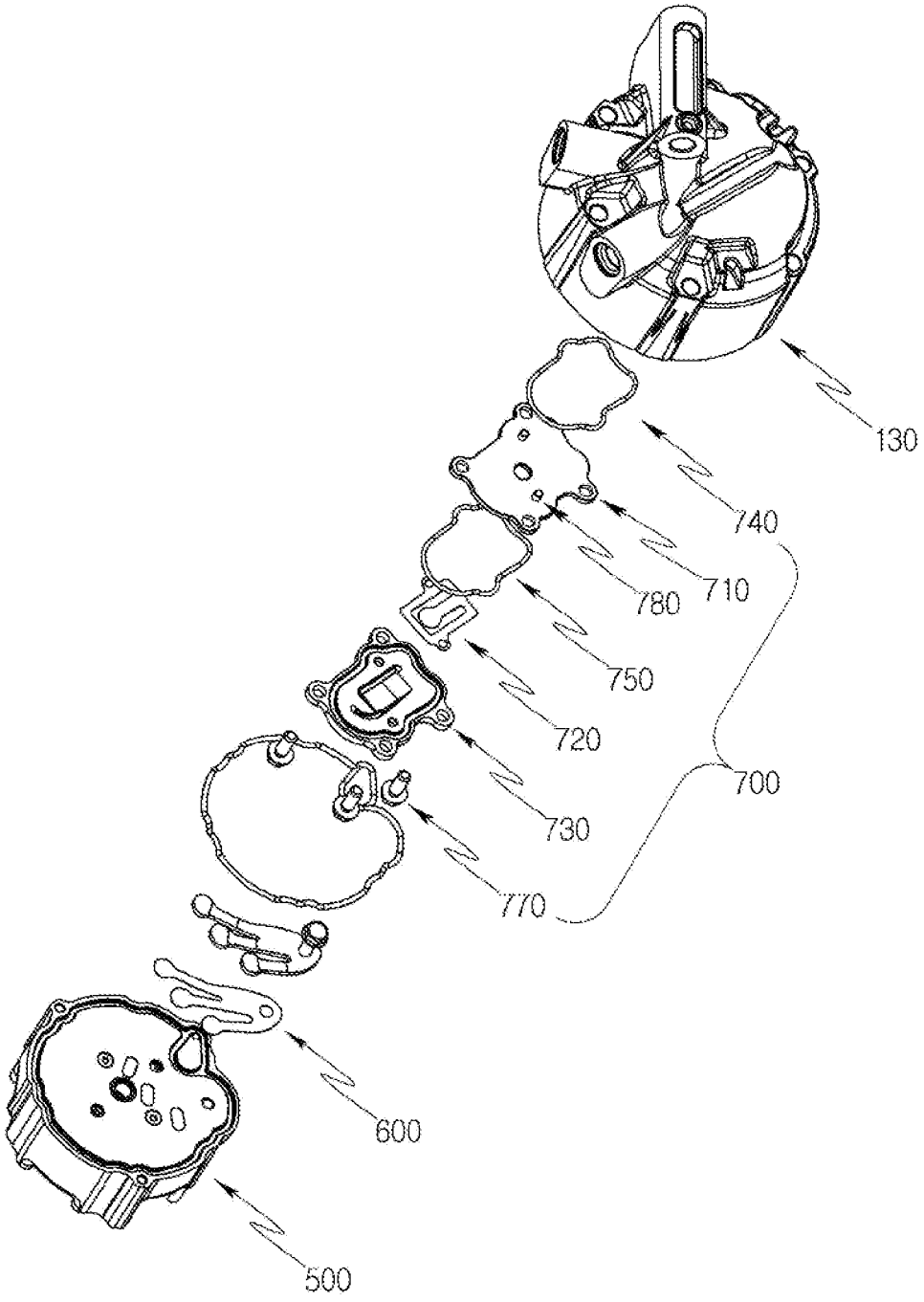
FIG. 8 is an exploded perspective view showing parts accommodated in the rear housing of FIG. 7.
Figure 9:
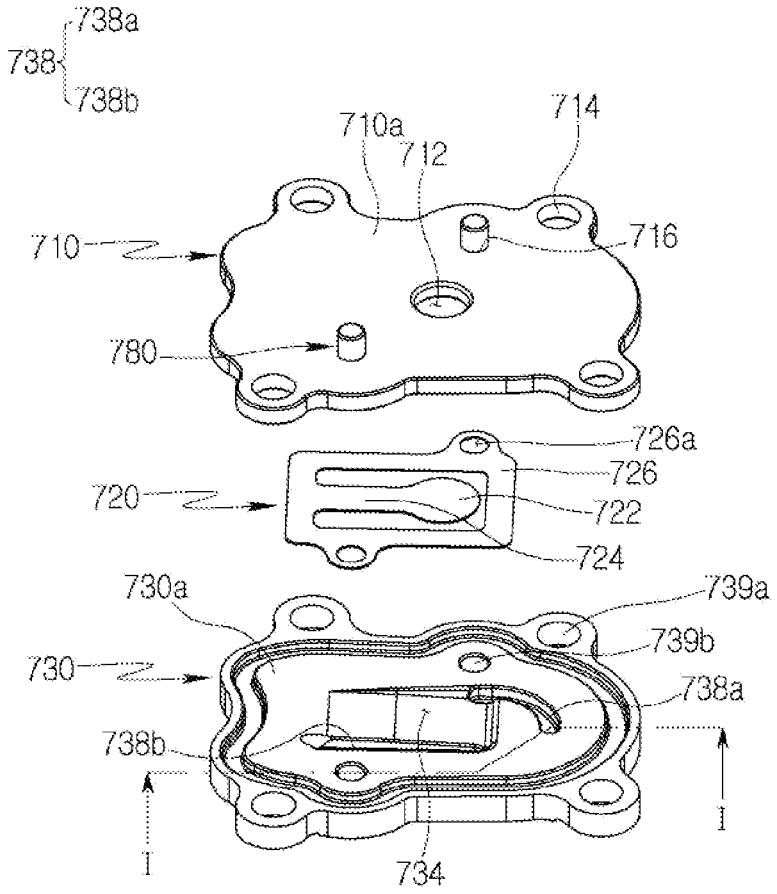
FIG. 9 is an exploded perspective view showing an injection valve assembly of the parts of FIG. 8.
Figure 10:
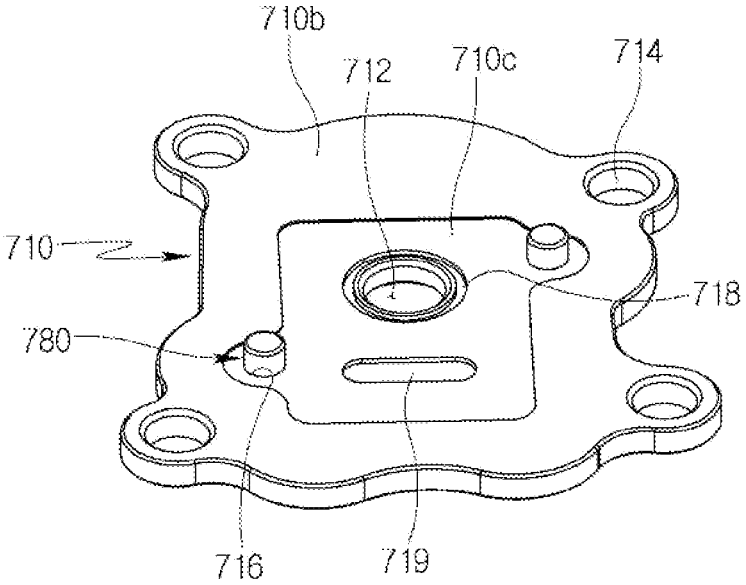
FIG. 10 is a perspective view showing a rear surface of a cover plate of the injection valve assembly of FIG. 9.
Figure 11:
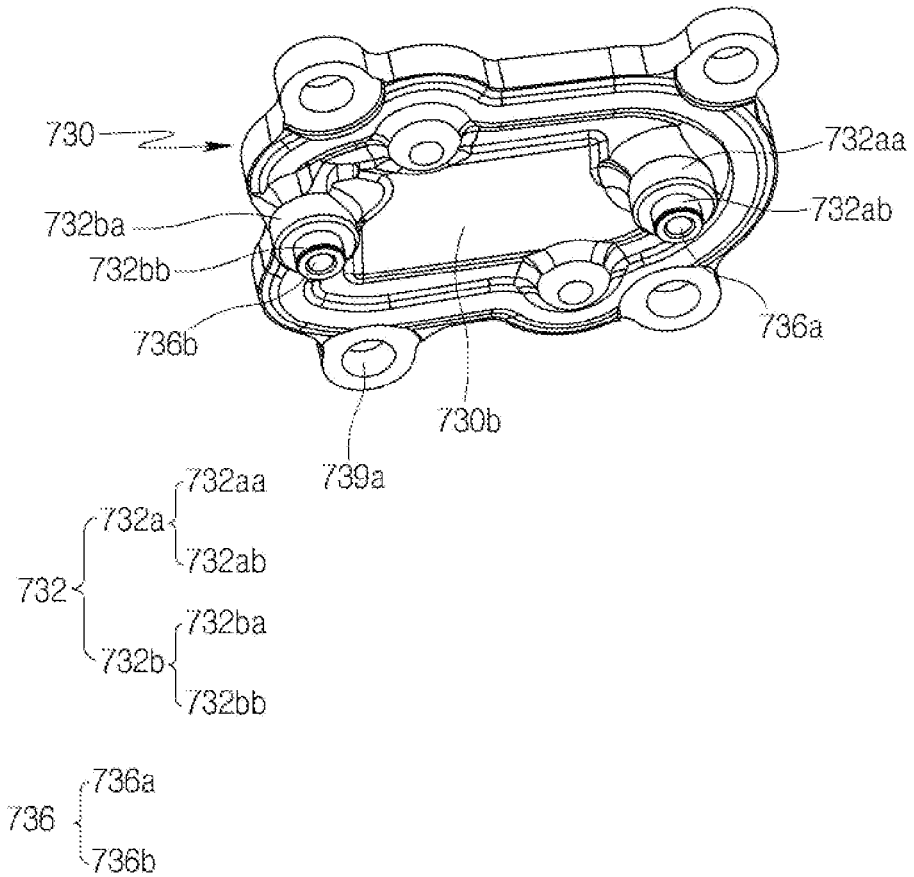
FIG. 11 is a perspective view showing a rear surface of a valve plate of the injection valve assembly of FIG. 9.
Figure 12:
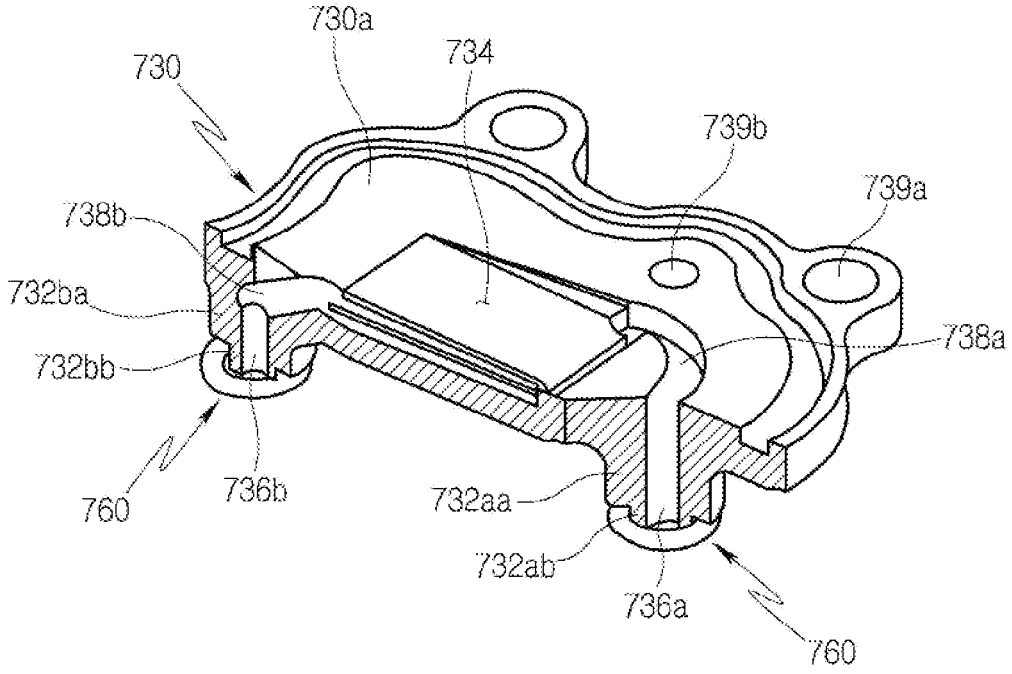
FIG. 12 is a perspective view taken along line I-I of FIG. 9.
Figure 13:
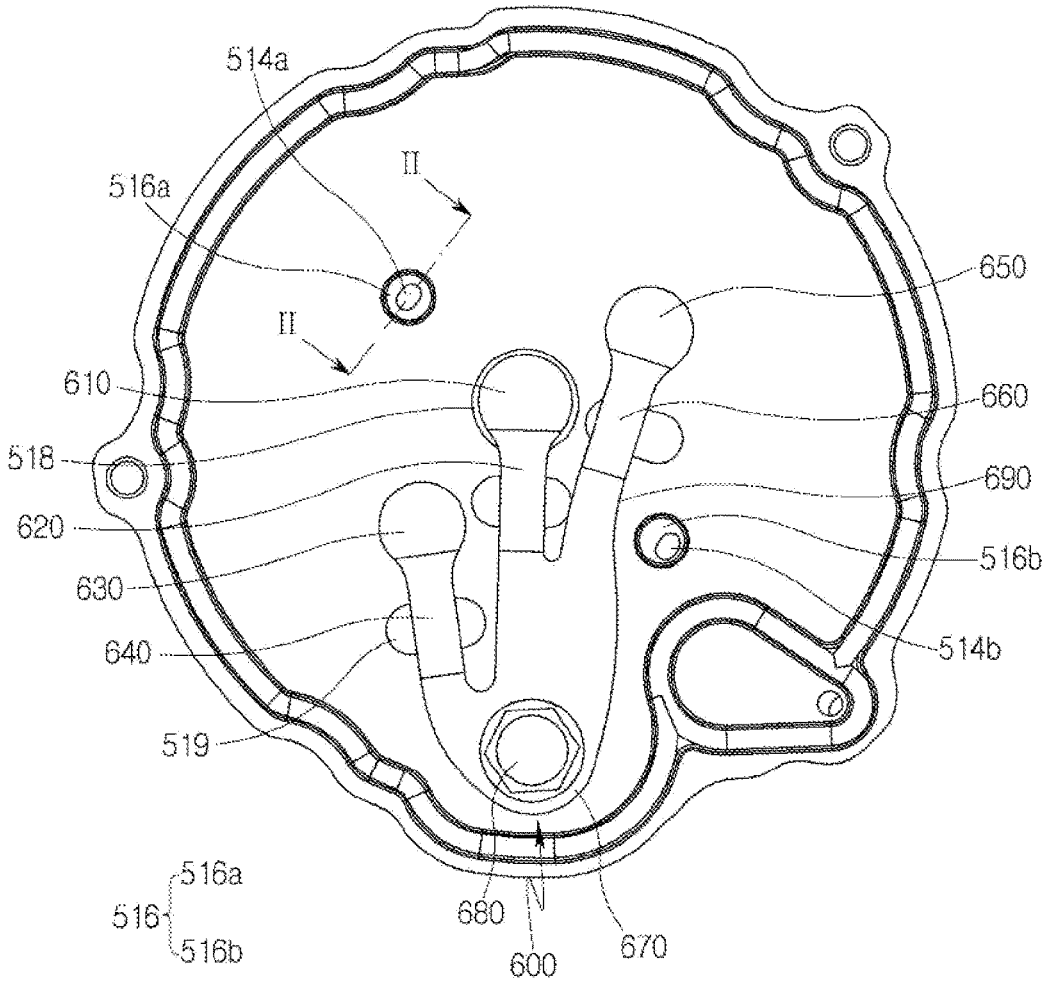
FIG. 13 is a front view showing a fixed scroll and a discharge valve among the parts of FIG. 8.
Figure 14:
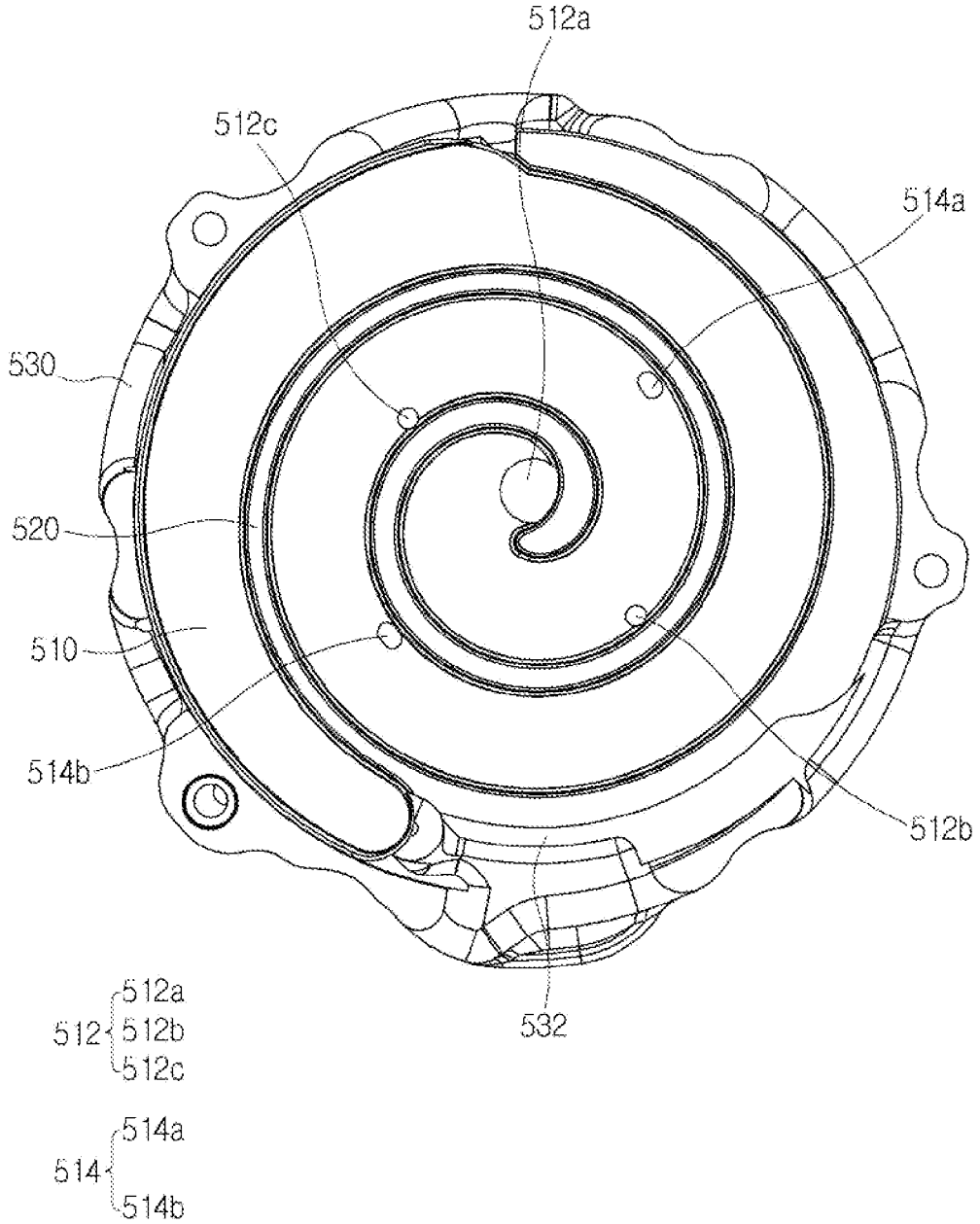
FIG. 14 is a rear view of FIG. 13.
Figure 15:
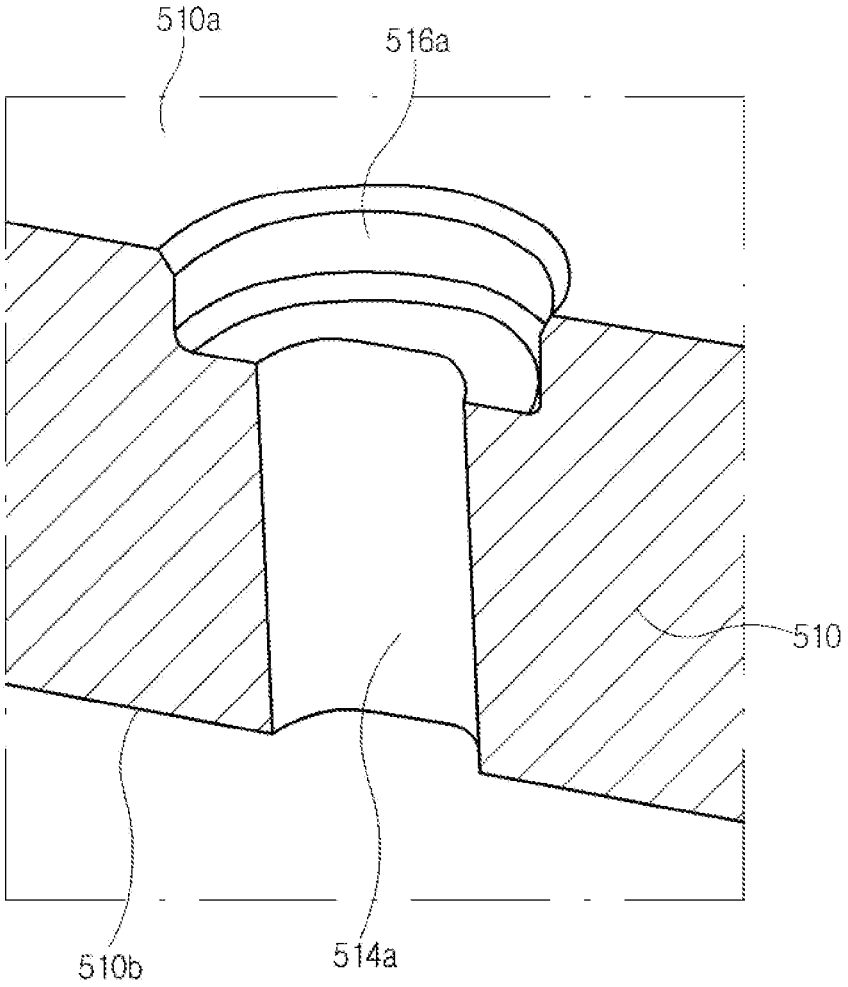
FIG. 15 is a perspective view taken along line II-II of FIG. 13.

FIG. 2 is a cross-sectional view showing a scroll compressor according to an embodiment of the present disclosure, FIG. 3 is a cross-sectional view showing a rear housing side of the scroll compressor of FIG. 2 from another direction, FIG. 4 is an enlarged cross-sectional view of part A of FIG. 3, FIG. 5 is a front view showing a rear housing of the scroll compressor of FIG. 2, FIG. 6 is a rear view of FIG. 5, FIG. 7 is a perspective view showing a part of the rear housing cut away as a perspective view of FIG. 6, FIG. 8 is an exploded perspective view showing parts accommodated in the rear housing of FIG. 7, FIG. 9 is an exploded perspective view showing an injection valve assembly of the parts of FIG. 8, FIG. 10 is a perspective view showing a rear surface of a cover plate of the injection valve assembly of FIG. 9, FIG. 11 is a perspective view showing a rear surface of a valve plate of the injection valve assembly of FIG. 9, FIG. 12 is a perspective view taken along line II of FIG. 9, FIG. 13 is a front view showing a fixed scroll and a discharge valve among the parts of FIG. 8, FIG. 14 is a rear view of FIG. 13, and FIG. 15 is a perspective view taken along line II-II of FIG. 13.

Figure 16:
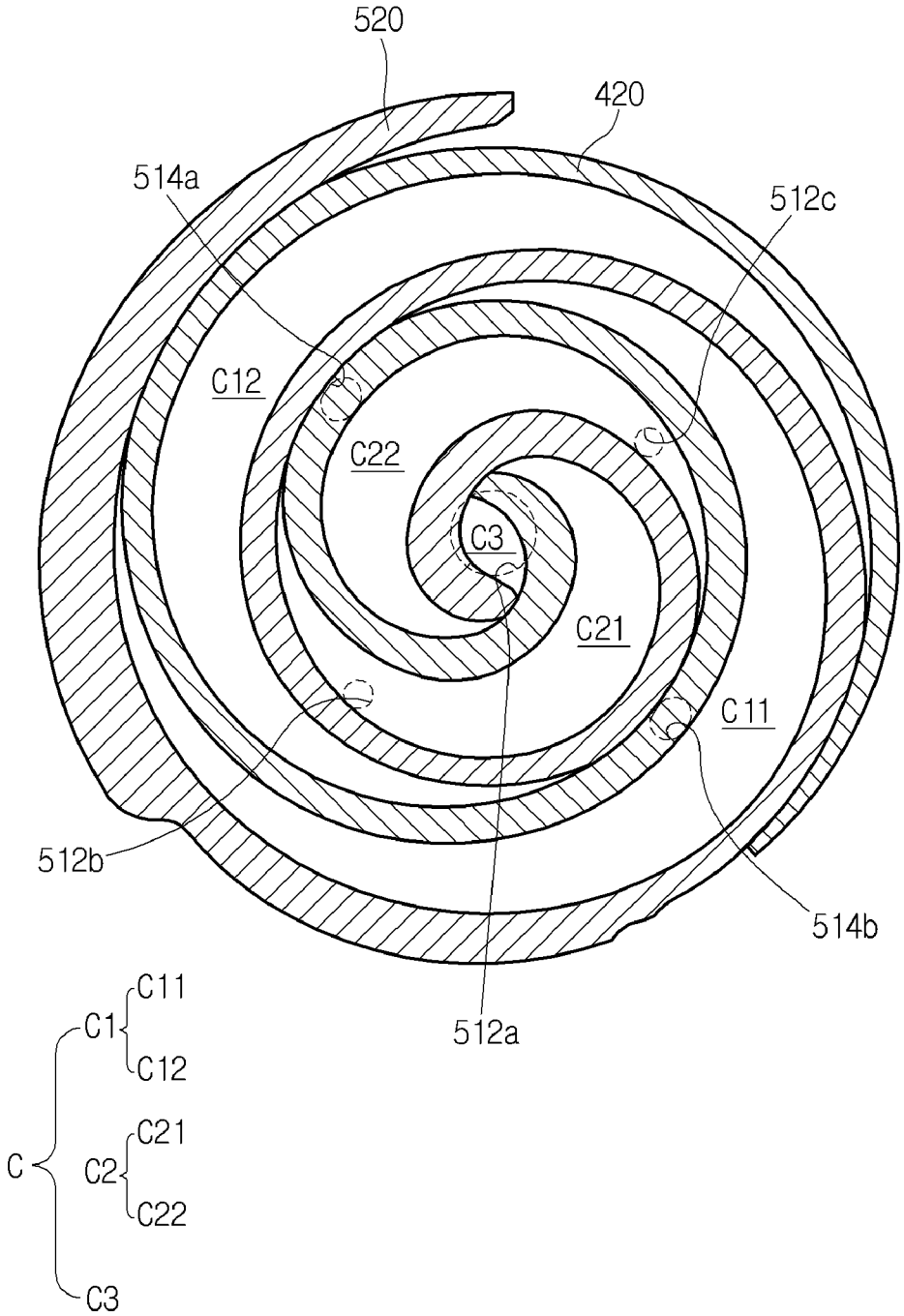
FIG. 16 is a cross-sectional view showing a fixed wrap, an orbiting wrap and an injection hole when a rotation angle of a rotating shaft is a first angle to explain the opening and closing operation of the injection hole of FIG. 13.
Figure 17:
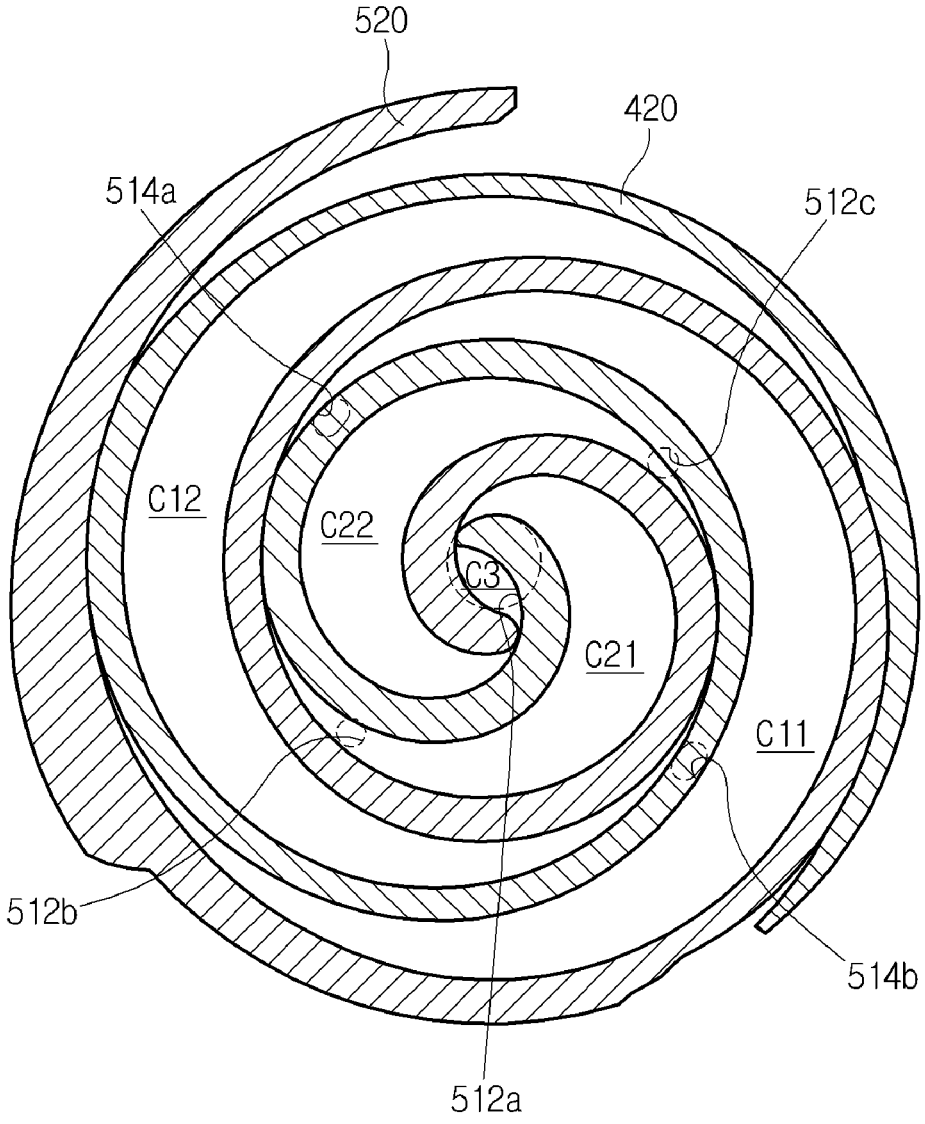
FIG. 17 is a cross-sectional view showing a fixed wrap, an orbiting wrap and an injection hole when a rotation angle of the rotating shaft is a second angle to explain the opening and closing operation of the injection hole of FIG. 13.
Figure 18:
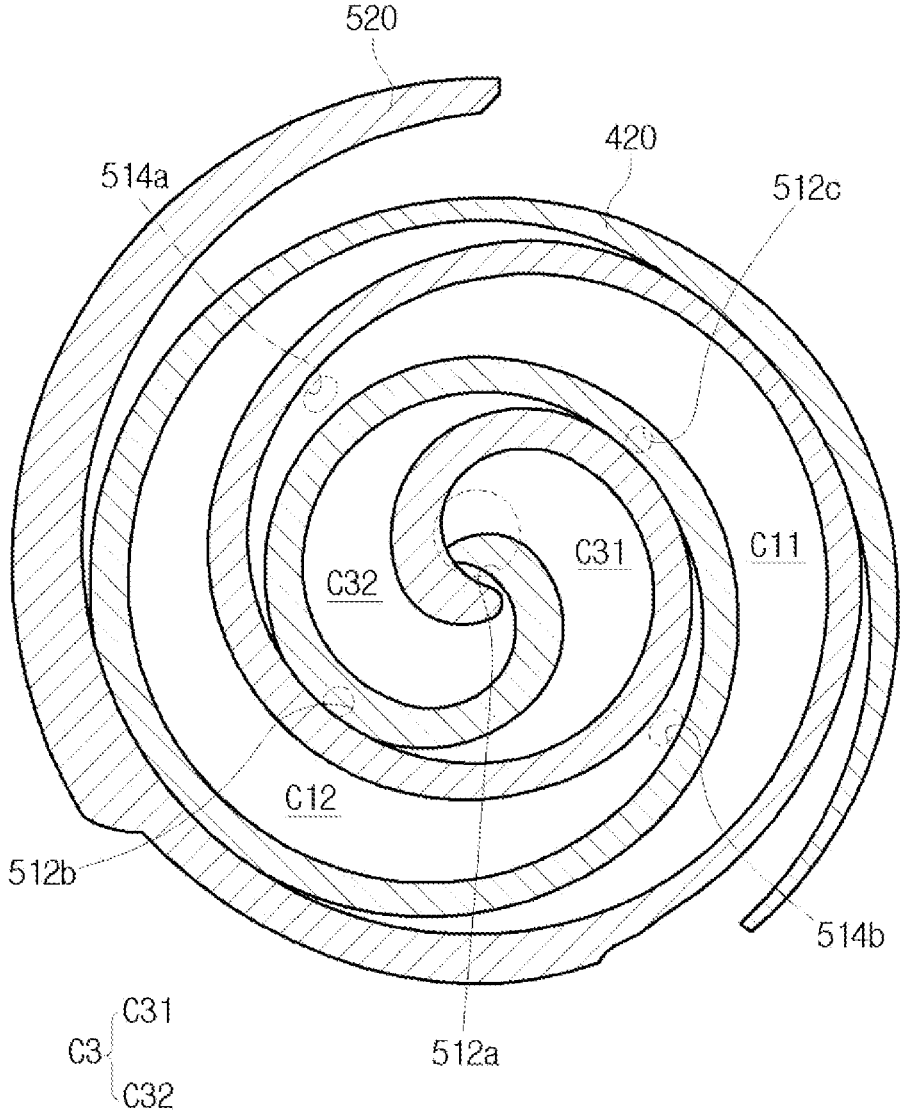
FIG. 18 is a cross-sectional view showing a fixed wrap, an orbiting wrap and an injection hole when a rotation angle of the rotating shaft is a third angle to explain the opening and closing operation of the injection hole of FIG. 13.
Figure 19:
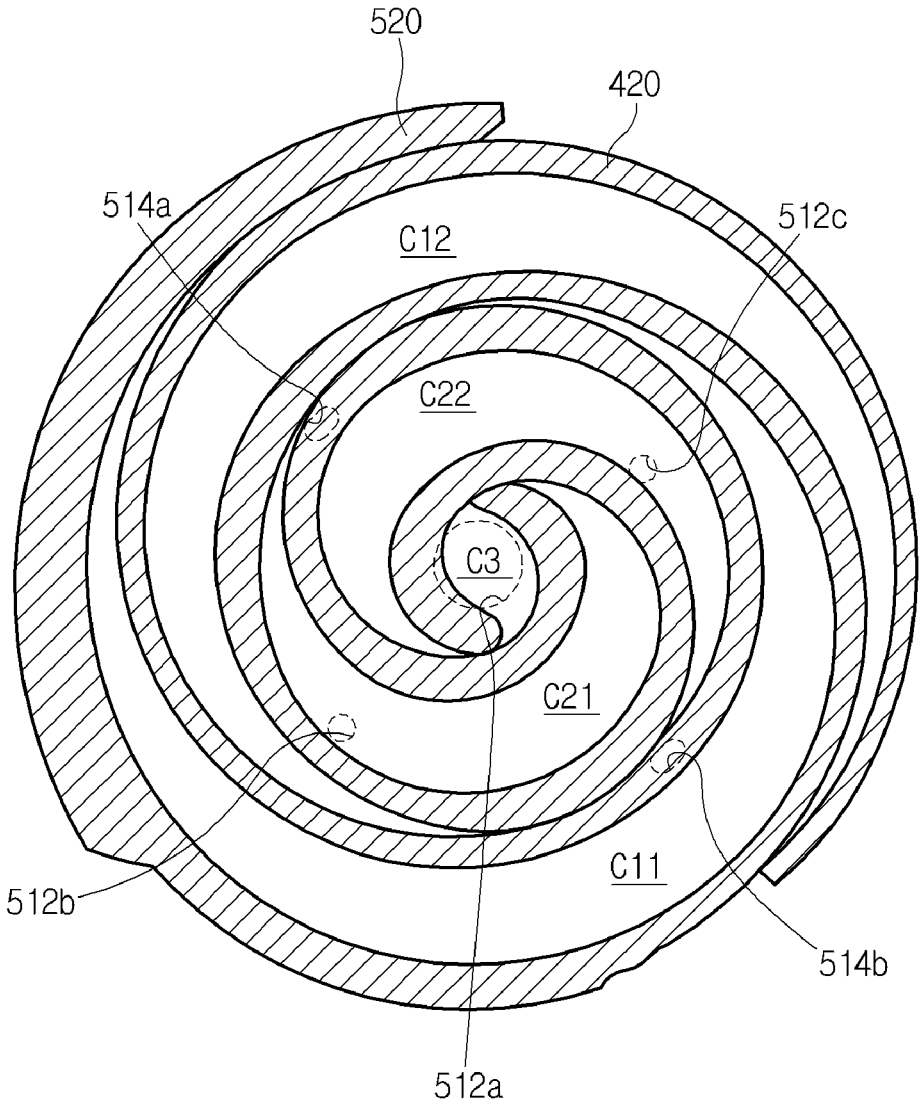
FIG. 19 is a cross-sectional view showing a fixed wrap, an orbiting wrap and an injection hole when a rotation angle of the rotating shaft is a fourth angle to explain the opening and closing operation of the injection hole of FIG. 13.

In addition, FIGS. 16 to 19 are cross-sectional views for explaining the opening and closing operation of the injection hole of FIG. 13, especially, FIG. 16 is a cross-sectional view showing a fixed wrap, orbiting wrap and injection hole when a rotation angle of a rotating shaft is a first angle, FIG. 17 is a cross-sectional view showing the fixed wrap, orbiting wrap and injection hole when the rotation angle of the rotating shaft is a second angle, and FIG. 18 is a cross-sectional view showing the fixed wrap, orbiting wrap and an injection hole when the rotation angle of the rotating shaft is a third angle, and FIG. 19 is a cross-sectional view showing the fixed wrap, orbiting wrap, and injection hole when the rotation angle of the rotating shaft is a fourth angle.

Figure 20:
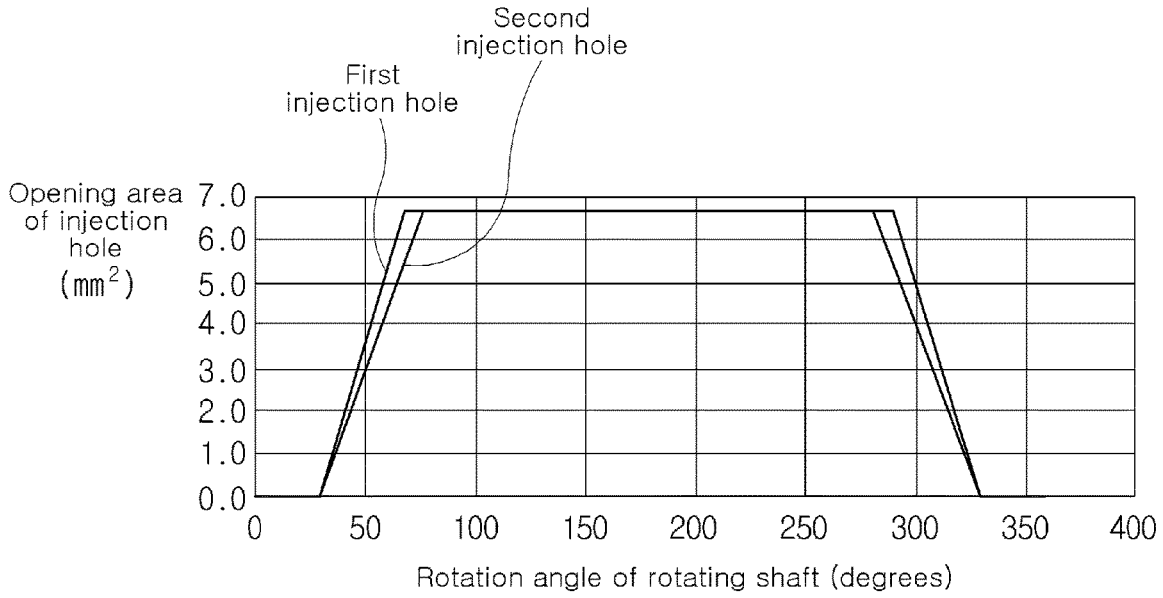
FIG. 20 is a diagram showing the opening and closing timing of the injection hole of FIG. 13.
Figure 21:
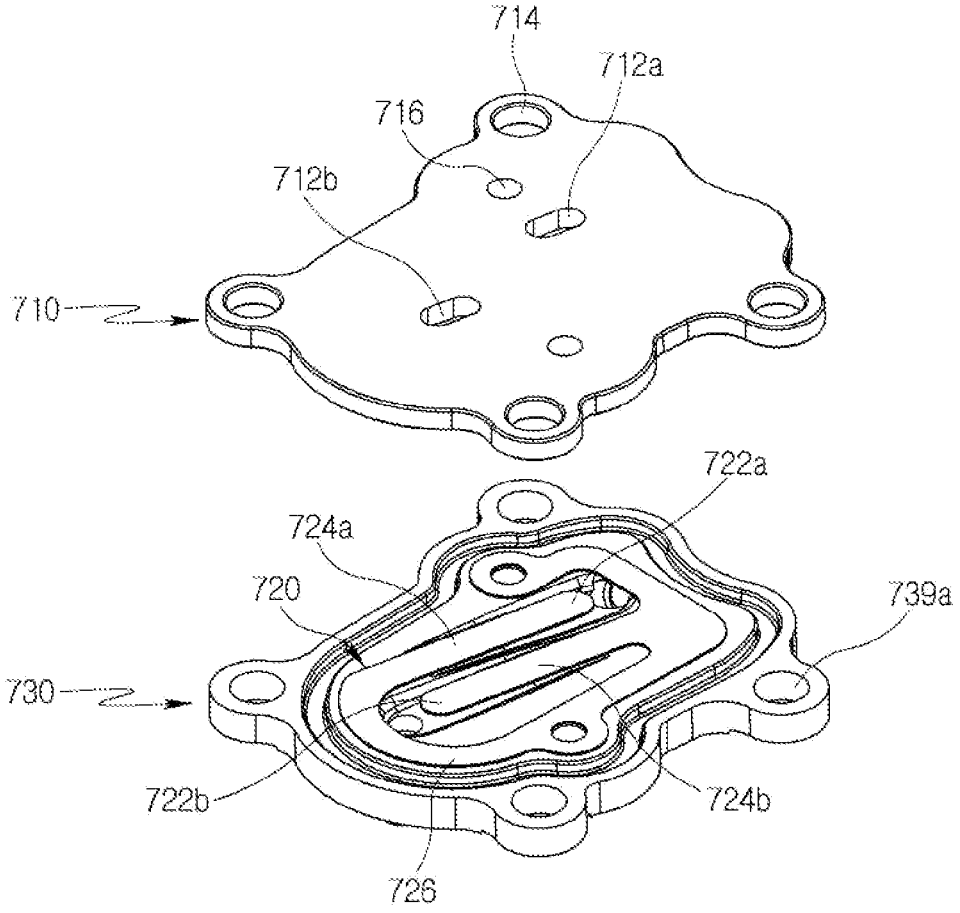
FIG. 21 is an exploded perspective view showing an injection valve assembly in a scroll compressor according to another embodiment of the present disclosure.
Figure 22:
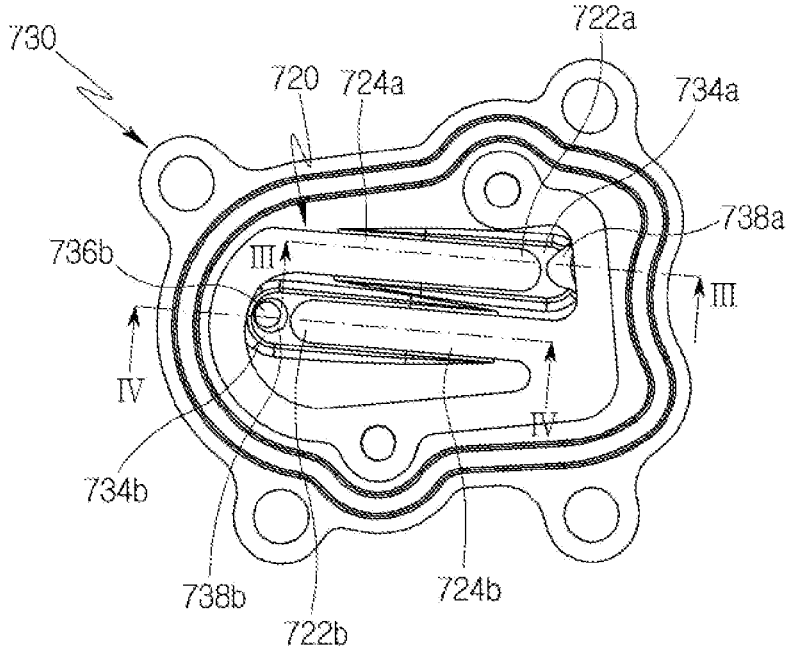
FIG. 22 is a plan view showing an injection valve and a valve plate of FIG. 21.
Figure 23:
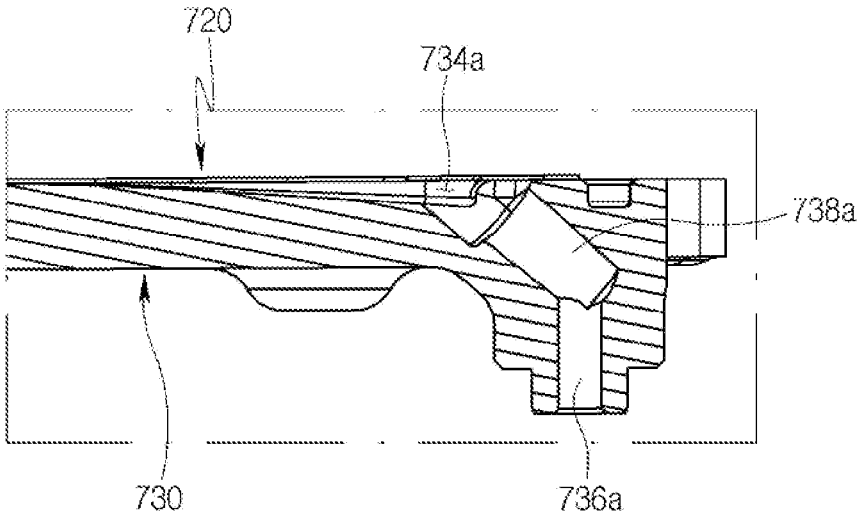
FIG. 23 is a cross-sectional view taken along line III-III of FIG. 22.
Figure 24:
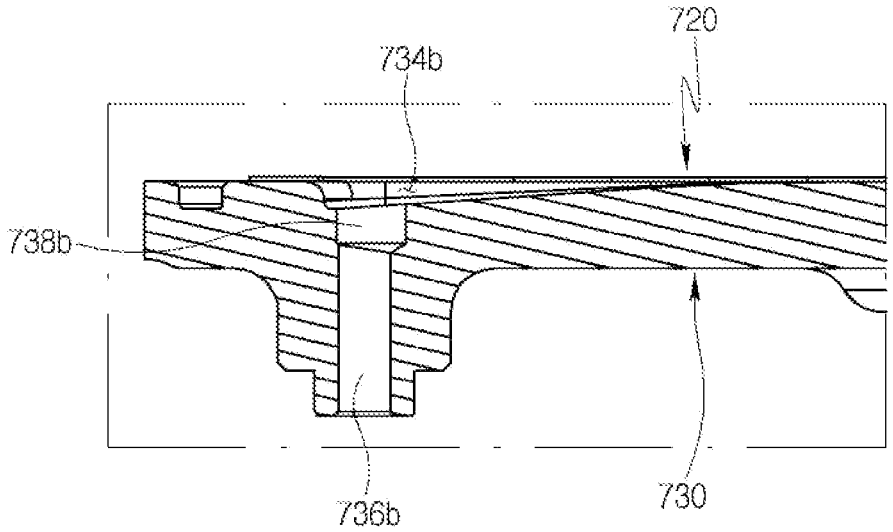
FIG. 24 is a cross-sectional view taken along line IV-IV of FIG. 22.

In addition, FIG. 20 is a diagram showing the opening and closing timing of the injection hole of FIG. 13.

Referring to FIGS. 2 to 20, a scroll compressor according to an embodiment of the present disclosure may include a housing 100, a motor 200 provided in the housing 100, a rotating shaft 300 rotated by the motor 200, an orbital scroll 400 orbital moved by the rotating shaft 300, and a fixed scroll 500 forming a compression chamber C with the orbital scroll 400.

And, the scroll compressor according to this embodiment may further include an injection flow path to guide intermediate pressure refrigerant from an outside of the housing 100 (in a vapor compression refrigeration cycle including a scroll compressor, condenser, expansion valve and evaporator, for example downstream of the condenser) into the compression chamber C and an injection valve assembly 700 for opening and closing the injection flow path.

Here, the injection flow path is formed extending from a rear housing 130 to the fixed scroll 500 by including an introduction port 133, introduction chamber I, inlet 712, inclined space 734, connection flow path 738, outlet 736 and injection hole 514 to be described later, and the injection valve assembly 700 may be interposed between the rear housing 130 and the fixed scroll 500 by including an inlet 712, inclined space 734, connection flow path 738 and outlet 736 to be described later.

Specifically, as shown in FIG. 2, the housing 100 may include a center housing 110 through which the rotating shaft 300 passes, a front housing 120 forming a motor accommodating space S1 in which the motor 200 is accommodated together with the center housing 110, and a rear housing 130 forming a scroll accommodating space S2 in which the orbital scroll 400 and the fixed scroll 500 are accommodated together with the center housing 110.

The center housing 110 may include a center base plate 112 partitioning the motor accommodating space S1 and the scroll accommodating space S2 and supporting the orbital scroll 400 and the fixed scroll 500, and a center side plate 114 protruding from an outer periphery of the center base plate 112 to the front housing 120.

The center base plate 112 is formed in a substantially circular plate shape, and a shaft hole 112*a* through which one end of the rotating shaft 300 passes and a back pressure chamber 112*b* for pressing the orbital scroll 400 toward the fixed scroll 500 may be formed in the center of the center base plate 112. Here, an eccentric bush 310 for converting the rotational motion of the rotating shaft 300 into the orbital motion of the orbital scroll 400 is formed at one end of the rotating shaft 300, and the back pressure chamber 112*b* also provides space for rotation of the eccentric bush 310.

In addition, a suction flow path (not illustrated) guiding the refrigerant flowing into the motor accommodating space S1 to the scroll accommodating space S2, as will be described later, may be formed on the outer periphery of the center base plate 112.

The front housing 120 may include a front base plate 122 facing the center base plate 112 and supporting the other end of the rotating shaft 300, and a front side plate 124 protruding from an outer periphery of the front base plate 122, coupled to the center side plate 114, and supporting the motor 200.

Here, the center base plate 112, the center side plate 114, the front base plate 122, and the front side plate 124 may form the motor accommodating space S1.

In addition, a suction port (not illustrated) guiding a refrigerant having a suction pressure from an outside to the motor accommodating space S1 may be formed on the front side plate 124.

As shown in FIGS. 2, 3 and 5 to 8, the rear housing 130 may include a discharge chamber D for receiving the refrigerant discharged from the compression chamber C, a discharge port 131 guiding the refrigerant of the discharge chamber D to the outside of the housing 100, an introduction port 133 into which intermediate pressure refrigerant is introduced from the outside of the housing 100, and an introduction chamber I accommodating the refrigerant introduced through the introduction port 133, wherein at least a portion of the introduction chamber I may be formed to be accommodated in the discharge chamber D, wherein at least a portion of the discharge port 131 may be formed to be accommodated in the introduction chamber I, and wherein at least a portion of the introduction port 133 may be formed to be accommodated in the discharge chamber D.

Specifically, the rear housing 130 may include a rear base plate 132 opposite to the center base plate 112, a first annular wall 134 protruding from the rear base plate 132 and located at the outermost side in the circumferential direction of the rear housing 130, a second annular wall 136 protruding from the rear base plate 132 and accommodated in the first annular wall 134, and a third annular wall 138 protruding from the rear base plate 132 and accommodated in the second annular wall 136.

The first annular wall 134 may be formed in an annular shape having a diameter approximately equal to that of the outer periphery of the center base plate 112, may be coupled to the outer periphery of the center base plate 112, and may form the scroll accommodating space S2.

The second annular wall 136 may be formed in an annular shape having a smaller diameter than the first annular wall 134, and may be in contact with the outer periphery of a fixed base plate 510 to be described later, and may form the discharge chamber D.

Here, as the second annular wall 136 is formed to be in contact with a fixed base plate 510 to be described later, when the rear housing 130 is coupled to the center housing 110, the fastening force between the center housing 110 and the fixed scroll 500 may be improved by pressing the fixed scroll 500 toward the center housing 110, thus leakage between the fixed scroll 500 and the center housing 110 may be prevented.

The third annular wall 138 may be formed in an annular shape having a smaller diameter than the second annular wall 136, may be spaced apart from a fixed base plate 510 to be described later, and may be covered by a cover plate 710 to be described later, to form the introduction chamber I.

And, the third annular wall 138 may include a fastening groove 138*a* into which a fastening bolt 770 fastening the injection valve assembly 700 to the third annular wall 138 is inserted, and a first positioning groove 138*b* into which a positioning pin 780 aligning a cover plate 710, injection valve 720 and valve plate 730 to be described later to a predetermined position is inserted.

The discharge port 131 is formed in the rear base plate 132, and the discharge port 131 may be formed to extend from a center of the rear base plate 132 to one side of an outer periphery of the rear base plate 132 in a radial direction of the rear base plate 132.

In addition, a discharge port inlet 131*a* guiding the refrigerant of the discharge chamber D to the discharge port 131 may be formed in the rear base plate 132.

On the other hand, a tubular oil separator (not illustrated) separating oil from refrigerant is provided inside the discharge port 131, and the oil separator (not illustrated) may be formed so that refrigerant is separated from oil during discharge process in which the refrigerant introduced into the discharge port inlet 131*a* flows to the center side of the rear base plate 132 along a space between an outer circumferential surface of the oil separator (not illustrated) and an inner circumferential surface of the discharge port 131 and then is turned and discharged along an inner circumference of the oil separator (not illustrated) to one side of the outer circumference of the rear base plate 132.

In addition, the introduction port 133 is also formed in the rear base plate 132, the introduction port 133 may be formed extending from the other side of the outer periphery of the rear base plate 132 to the center of the rear base plate 132 in the radial direction of the rear base plate 132, and may be communicated with the introduction chamber I.

Here, as the third annular wall 138 is formed to be accommodated in the second annular wall 136, and the third annular wall 138 is spaced apart from a fixed base plate 510 to be described later and covered by the injection valve assembly 700, at least a portion of the introduction chamber I may be accommodated in the discharge chamber D. That is, a side of the introduction chamber I may be formed to overlap the discharge chamber D in the radial direction of the rear housing 130 with the third annular wall 138 interposed therebetween, and an end of the introduction chamber I may be formed to overlap the discharge chamber D in the axial direction of the rear housing 130 with the injection valve assembly 700 interposed therebetween.

And, as the discharge port 131 extends from the center of the rear base plate 132 to one side of the outer periphery of the rear base plate 132 in the radial direction of the rear base plate 132, at least a portion of the discharge port 131 may be accommodated in the introduction chamber I. That is, at least a portion of the discharge port 131 may be formed to overlap the introduction chamber I in the axial direction of the rear housing 130 with a wall portion of the discharge port 131 interposed therebetween.

And, as the introduction port 133 extends from the other side of the outer periphery of the rear base plate 132 to the center of the rear base plate 132 in the radial direction of the rear base plate 132, at least a portion of the introduction port 133 may be accommodated in the discharge chamber D. That is, at least a portion of the introduction port 133 may be formed to overlap the discharge chamber D in the axial direction of the rear housing 130 with a wall portion of the introduction port 133 interposed therebetween.

On the other hand, the discharge port 131 and the introduction port 133 may be formed so that the refrigerant of the discharge port 131 and the refrigerant of the introduction port 133 flow in a cross-flow direction with each other. That is, an angle between an outlet of the discharge port 131 and an inlet of the introduction port 133 with respect to the center of the rear housing 130 may be formed to be greater than or equal to 0 degrees and less than 90 degrees.

As shown in FIG. 2, the motor 200 may include a stator 210 fixed to the front side plate 124 and a rotor 220 rotated by interaction with the stator 210 inside the stator 210.

As shown in FIG. 2, the rotating shaft 300 is coupled to the rotor 220 and passes through a center of the rotor 220, and one end of the rotating shaft 300 passes through the shaft hole 112*a* of the center base plate 112, and the other end of the rotating shaft 300 may be supported on the front base plate 122.

As shown in FIGS. 2 and 16 to 19, the orbital scroll 400 may be interposed between the center base plate 112 and the fixed scroll 500, and may include a disk-shaped orbiting base plate 410, an orbiting wrap 420 protruding from a center of the orbiting base plate 410 to the fixed scroll 500, and a boss portion 430 protruding from the center of the orbiting base plate 410 to the opposite side of the orbiting wrap 420 and coupled to the eccentric bush 310.

As shown in FIGS. 2 to 4, 8, 13 to 19, the fixed scroll 500 may include a disk-shaped fixed base plate 510, a fixed wrap 520 protruding from a center of the fixed base plate 510 and engaged with the orbiting wrap 420, and a fixed side plate 530 protruding from an outer periphery of the fixed base plate 510 and coupled to the center base plate 112.

The fixed base plate 510 may include a discharge hole 512 discharging the refrigerant of the compression chamber C to the discharge chamber D, and an injection hole 514 guiding the refrigerant discharged from the injection valve assembly 700 to the compression chamber C.

The discharge hole 512 may be formed in plurality to prevent the refrigerant from being overcompressed, and the plurality of discharge holes 512 may be opened and closed by a discharge valve 600 interposed between the fixed base plate 510 and the injection valve assembly 700.

Specifically, the compression chamber C includes a first compression chamber C1 positioned on the distal side in the radial direction of the scroll accommodating space S2 and having a first pressure, a second compression chamber C2 located on the centripetal side in the radial direction of the scroll accommodating space S2 with respect to the first compression chamber C1 and having a second pressure higher than the first pressure, and a third compression chamber C3 located on the centripetal side in the radial direction of the scroll accommodating space S2 with respect to the second compression chamber C2 and having a third pressure higher than the second pressure, wherein the first compression chamber C1, the second compression chamber C2, and the third compression chamber C3 may be formed as a pair, respectively.

That is, the first compression chamber C1 may include a first outer compression chamber C11 formed by an outer peripheral surface of the orbiting wrap 420 and an inner peripheral surface of the fixed wrap 520, and a first inner compression chamber C12 formed by an inner peripheral surface of the orbiting wrap 420 and an outer peripheral surface of the fixed wrap 520.

And, the second compression chamber C2 may include a second outer compression chamber C21 formed by the outer circumferential surface of the orbiting wrap 420 and the inner circumferential surface of the fixed wrap 520, and a second inner compression chamber C22 formed by the inner circumferential surface of the orbiting wrap 420 and the outer peripheral surface of the fixed wrap 520.

And, the third compression chamber C3 may include, a third outer compression chamber C31 formed by the outer circumferential surface of the orbiting wrap 420 and the inner circumferential surface of the fixed wrap 520, and a third inner compression chamber C32 formed by the inner circumferential surface of the orbiting wrap 420 and the outer peripheral surface of the fixed wrap 520. Here, the third outer compression chamber C31 and the third inner compression chamber C32 may be combined into one in the process of compressing the refrigerant as illustrated in FIGS. 18 and 19.

In this case, the discharge hole 512 may include a main discharge hole 512*a* formed in the center of the fixed base plate 510 to discharge the refrigerant of the third outer compression chamber C31 and the third inner compression chamber C32, a first sub discharge hole 512*b* formed outside the fixed base plate 510 in a radial direction with respect to the main discharge hole 512*a* to discharge the refrigerant of the second outer compression chamber C21, and a second sub discharge hole 512*c* formed outside the fixed base plate 510 in a radial direction with respect to the main discharge hole 512*a* and formed on the opposite side of the first sub discharge hole 512*b* with respect to the main discharge hole 512*a* to discharge the refrigerant of the second inner compression chamber C22.

In addition, the discharge valve 600 may include a main opening/closing portion 610 opening and closing the main discharge hole 512*a*, a first sub opening/closing portion 630 opening and closing the first sub discharge hole 512*b*, a second sub opening/closing portion 650 opening and closing the second sub discharge hole 512*c*, a fastening portion 670 fastened to the fixed base plate 510, a main supporting portion 620 extending from the main opening/closing portion 610 to the fastening portion 670, a first sub supporting portion 640 extending from the first sub opening/closing portion 630 to the fastening portion 670, and a second sub supporting portion 660 extending from the second sub opening/closing portion 650 to the fastening portion 670.

Here, the main opening/closing portion 610 opens the main discharge hole 512*a* when the pressures of the third outer compression chamber C31 and the third inner compression chamber C32 reach the discharge pressure level, the first sub opening/closing portion 630 opens the first sub discharge hole 512*b* when the pressure of the second outer compression chamber C21 exceeds the second pressure so that the pressure of the second outer compression chamber C21 is lowered to the second pressure, the second sub opening/closing portion 650 opens the second sub discharge hole 512*c* when the pressure of the second inner compression chamber C22 exceeds the second pressure so that the pressure of the second inner compression chamber C22 is lowered to the second pressure, thereby preventing the pressure of the refrigerant discharged from the main discharge hole 512*a* from being excessively higher than the discharge pressure. That is, overcompression may be prevented.

Meanwhile, in order not to cause a pressure imbalance between the second outer compression chamber C21 and the second inner compression chamber C22, the first sub discharge hole 512*b* and the second sub discharge hole 512*c* may be formed to communicate with the second outer compression chamber C21 and the second inner compression chamber C22 at the same time. That is, when communication between the first sub discharge hole 512*b* and the second outer compression chamber C21 is started, the communication between the second sub discharge hole 512*c* and the second inner compression chamber C22 may be started.

Also, preferably, the first sub discharge hole 512*b* and the second sub discharge hole 512*c* may be formed to be simultaneously blocked from the second outer compression chamber C21 and the second inner compression chamber C22. That is, when the communication between the first sub discharge hole 512*b* and the second outer compression chamber C21 is terminated, the communication between the second sub discharge hole 512*c* and the second inner compression chamber C22 may be terminated.

On the other hand, in order to minimize the increase in cost and weight caused by the discharge valve 600, the main opening/closing portion 610, the first sub opening/closing portion 630, the second sub opening/closing portion 650, and the fastening portion 670, the main supporting portion 620, the first sub supporting portion 640 and the second sub supporting portion 660 may be integrally formed, and a circumferential width of the fastening portion 670 may be formed smaller than a distance between the first sub opening/closing portion 630 and the second sub opening/closing portion 650, and the discharge valve 600 may be fastened to the fixed base plate 510 by one fastening member 680. Here, the one fastening member 680 may be preferably fasten to a fixed wrap entry 532 having a relatively large thickness and height to be described later, so that the discharge valve 600 may receive sufficient support even if it is fastened to the fixed base plate 510 by the one fastening member 680.

In addition, the discharge valve 600 is not only integrally formed as described above, but also has a narrow width of the fastening portion 670 and is fastened to the fixed base plate 510 by the single fastening member 680, so the degree of freedom in design is low, and at least one of the first sub supporting portion 640 and the second sub supporting portion 660 may interfere with the injection hole 514, in order to prevent this, at least one of the first sub supporting portion 640 and the second sub supporting portion 660 may include an avoidance portion 690 formed to be engraved toward the main supporting portion 620.

The injection hole 514 may be formed as a long hole to increase the flow rate of the refrigerant injected into the compression chamber C.

In addition, the injection hole 514 may have a uniform cross-sectional shape so that pressure loss and flow rate loss do not occur while the refrigerant passes through the injection hole 514. That is, an inner diameter of the injection hole 514 may be formed to a predetermined value irrespective of the axial position of the injection hole 514.

In addition, the injection hole 514 may be formed in plurality to supply the refrigerant discharged from the injection valve assembly 700 to the pair of first compression chamber C1. That is, the injection hole 514 may include a first injection hole 514*a* communicateable with the first outer compression chamber C11 and a second injection hole 514*b* communicateable with the first inner compression chamber C12, wherein the first injection hole 514*a* and the second injection hole 514*b* may be formed on opposite sides of each other with respect to an imaginary line connecting the first sub discharge hole 512*b* and the second sub discharge hole 512*c*.

Here, in order to prevent a pressure imbalance between the first outer compression chamber C11 and the first inner compression chamber C12 from occurring, the injection hole 514 may be formed to communicate with the first outer compression chamber C11 and the first inner compression chamber C12 at the same time. That is, as shown in FIGS. 16 to 20, when the communication between the first injection hole 514*a* and the first outer compression chamber C11 starts, the communication between the second injection hole 514*b* and the first inner compression chamber C12 may start.

And, preferably, the injection hole 514 may be formed to be blocked simultaneously with the first outer compression chamber C11 and the first inner compression chamber C12. That is, as shown in FIGS. 16 to 20, when the communication between the first injection hole 514*a* and the first outer compression chamber C11 is terminated, the communication between the second injection hole 514*b* and the first inner compression chamber C12 may be terminated.

Meanwhile, the fixed base plate 510 may further include a small-diameter portion insertion groove 516 to prevent refrigerant leakage when the refrigerant flows from the injection valve assembly 700 to the first injection hole 514*a* and the second injection hole 514*b*. That is, the fixed base plate 510 may further include a first small-diameter portion insertion groove 516*a* into which a first small-diameter portion 732*ab* to be described later is inserted, and a second small-diameter portion insertion groove 516*b* into which a second small-diameter portion 732*bb* to be described later is inserted.

Specifically, the fixed base plate 510 may include a fixed base plate upper surface 510*a* opposite to the injection valve assembly 700 and a fixed base plate lower surface 510*b* forming the rear surface of the fixed base plate upper surface 510*a* and opposite to the orbital scroll 400.

In addition, the first small-diameter portion insertion groove 516*a* is engraved from the fixed base plate upper surface 510*a* toward the fixed base plate lower surface 510*b*, and a first small-diameter portion 732*ab* to be described later is inserted therein, and the first injection hole 514*a* is engraved from the fixed base plate lower surface 510*b* toward the fixed base plate upper surface 510*a* and may communicate with the first small-diameter portion insertion groove 516*a*.

In addition, the second small-diameter portion insertion groove 516*b* is engraved from the fixed base plate upper surface 510*a* toward the fixed base plate lower surface 510*b*, and a second small-diameter portion 732*bb* to be described later is inserted therein, and the second injection hole 514*b* is engraved from the fixed base plate lower surface 510*b* toward the fixed base plate upper surface 510*a* and may communicate with the second small-diameter portion insertion groove 516*b*.

Here, as shown in FIG. 4, an inner diameter of the first small-diameter portion 732*ab* (inner diameter of a first outlet 736*a* to be described later) to be described later may be formed to be greater than or equal to an inner diameter of the first injection hole 514*a*, and the inner diameter of the first small-diameter portion insertion groove 516*a* may be formed at the same level as an outer diameter of the first small-diameter portion 732*ab* to be described later, so that a first small-diameter portion 732*ab* to be described later may be inserted into the first small-diameter portion insertion groove 516*a*, and pressure loss and flow rate loss do not occur while the refrigerant flows from the injection valve assembly 700 to the first injection hole 514*a*. That is, since an outer diameter of the first small-diameter portion 732*ab* to be described later is larger than an inner diameter of the first small-diameter portion 732*ab* to be described later, the inner diameter of the first small-diameter portion insertion groove 516*a* may be larger than the inner diameter of the first injection hole 514*a*.

In addition, an inner diameter of the second small-diameter portion 732*bb* (inner diameter of a second outlet 736*b* to be described later) to be described later may be formed to be greater than or equal to the inner diameter of the second injection hole 514*b*, and the inner diameter of the second small-diameter portion insertion groove 516*b* may be formed at the same level as an outer diameter of the second small-diameter portion 732*bb* to be described later, so that a second small-diameter portion 732*bb* to be described later may be inserted into the second small-diameter portion insertion groove 516*b*, and pressure loss and flow rate loss do not occur while the refrigerant flows from the injection valve assembly 700 to the second injection hole 514*b*. That is, since an outer diameter of the second small-diameter portion 732*bb* to be described later is larger than an inner diameter of the second small-diameter portion 732*bb* to be described later, the inner diameter of the second small-diameter portion insertion groove 516*b* may be formed to be larger than the inner diameter of the second injection hole 514*b*.

The fixed wrap 520 may be formed to extend, for example, in a logarithmic spiral from the central side of the fixed scroll 500 to the outer peripheral side of the fixed scroll 500.

The fixed side plate 530 is formed in an annular shape extending along the outer periphery of the fixed base plate 510, and may include a fixed wrap entry 532 connected to the fixed wrap 520 on one side.

In the fixed wrap entry 532, an axial height of the fixed wrap entry 532 may be formed at the same level as an axial height of the fixed wrap 520 so that the refrigerant of the compression chamber C does not leak through the fixed wrap entry 532.

In addition, in the fixed wrap entry 532, a radial thickness of the fixed wrap entry 532 may be formed to be thicker than a radial thickness of the fixed wrap 520 so that the support rigidity of the fixed wrap 520 is improved.

Here, in order to reduce the weight and cost of the fixed scroll 500, the fixed side plate 530 may be formed so that a radial thickness of portion except for the fixed wrap entry 532 is thinner than a radial thickness of the fixed wrap entry 532.

The injection valve assembly 700 may be formed on the end surface of the third annular wall 138 to communicate and block between the introduction chamber I and the injection hole 514.

Specifically, as shown in FIGS. 2 to 4 and 8 to 12, the injection valve assembly 700 may include a cover plate 710 fastened to the end surface of the third annular wall 138 to cover the introduction chamber I, a valve plate 730 fastened to the cover plate 710 from the opposite side of the introduction chamber I with respect to the cover plate 710, and an injection valve 720 interposed between the cover plate 710 and the valve plate 730.

The cover plate 710 may include a cover plate upper surface 710*a* opposite to the introduction chamber I and the third annular wall 138, a cover plate lower surface 710*b* opposite to the valve plate 730 and the injection valve 720, and an injection valve seating groove 710*c* formed in a concave manner from the cover plate lower surface 710*b* in the center of the cover plate 710.

And, the cover plate 710 may further include an inlet 712 communicating the introduction chamber I with an inclined space 734 to be described later, a second fastening hole 714 communicated with the fastening groove 138*a* and penetrated by the fastening bolt 770, and a first positioning hole 716 communicated with the first positioning groove 138*b* and penetrated by the positioning pin 780.

The inlet 712 may be formed in the center of the cover plate 710, and may be formed through the cover plate 710 from the cover plate upper surface 710*a* to the injection valve seating groove 710*c*.

The second fastening hole 714 may be formed on an outer periphery of the cover plate 710, and may be formed through the cover plate 710 from the cover plate upper surface 710*a* to the cover plate lower surface 710*b*.

The first positioning hole 716 is formed between the inlet 712 and the second fastening hole 714 in the radial direction of the cover plate 710, and may be formed through the cover plate 710 from the cover plate upper surface 710*a* to the injection valve seating groove 710*c*.

The injection valve 720 may include a head 722 opening and closing the inlet 712, a leg 724 supporting the head 722, and a periphery 726 supporting the leg 724.

The head 722 may be formed in a disk shape having an outer diameter greater than an inner diameter of the inlet 712.

The leg 724 may be formed in a plate shape extending from the head 722 to one side of the periphery 726 in one direction.

The periphery 726 may be formed in an annular shape accommodating the head 722 and the leg 724 while being accommodated in the injection valve seating groove 710*c*.

In addition, the periphery 726 may include a second positioning hole 726*a* communicated with the first positioning hole 716 and penetrated by the positioning pin 780.

Here, in the injection valve 720, an axial thickness of the periphery 726 may be formed to be greater than or equal to an axial depth of the injection valve seating groove 710*c* (More precisely, a distance between a base surface of the injection valve seating groove 710*c* and a valve plate upper surface 730*a* to be described later), so that the periphery 726 is fixed by being pressed between the injection valve seating groove 710*c* and the valve plate 730 without a separate fastening member for fixing the injection valve 720. At this time, in order to prevent the case where the periphery 726 is not compressed between the injection valve seating groove 710*c* and the valve plate 730 due to tolerance, it may be preferable that the axial thickness of the periphery 726 is designed to be larger than the axial depth of the injection valve seating groove 710*c*.

The valve plate 730 may include a valve plate upper surface 730*a* opposite to the cover plate 710 and the injection valve 720, and a valve plate lower surface 730*b* opposite to the fixed scroll 500 while forming a rear surface of the valve plate upper surface 730*a*.

In addition, the valve plate 730 may further include a protrusion 732 protruding from the valve plate lower surface 730*b* toward the first injection hole 514*a* and the second injection hole 514*b*. That is, the valve plate 730 may include, a first protrusion 732*a* protruding from one side of the valve plate lower surface 730*b* toward the first injection hole 514*a*, and a second protrusion 732*b* protruding from the other side of the valve plate lower surface 730*b* toward the second injection hole 514*b*.

In addition, the valve plate 730 may further include an inclined space 734 serving as a retainer of the injection valve 720 and accommodating the refrigerant flowing through the inlet 712, a first outlet 736*a* formed in the first protrusion 732*a* and communicating with the first injection hole 514*a*, a second outlet 736*b* formed in the second protrusion 732*b* and communicating with the second injection hole 514*b*, a first connection flow path 738*a* guiding the refrigerant of the inclined space 734 to the first outlet 736*a*, and a second connection flow path 738*b* guiding the refrigerant of inclined space 734 to the second outlet 736*b*.

The valve plate upper surface 730*a* may be formed as a plane in contact with the cover plate lower surface 710*b* and the periphery 726 of the injection valve 720.

The inclined space 734 may be formed to be engraved from the valve plate upper surface 730*a*.

And, the inclined space 734 may include a retainer surface supporting the head 722 and leg 724 of the injection valve 720 when the injection valve 720 opens the inlet 712.

The first outlet 736*a* may be engraved from the end surface of the first protrusion 732*a* (more precisely, an end surface of a first small-diameter portion 732*ab* to be described later).

The second outlet 736*b* may be engraved from the end surface of the second protrusion 732*b* (more precisely, an end surface of a second small-diameter portion 732*bb* to be described later).

The first connection flow path 738*a* may be engraved from the valve plate upper surface 730*a*, and may be formed to communicate one side of the inclined space 734 with the first outlet 736*a*.

The second connection flow path 738*b* may be engraved from the valve plate upper surface 730*a*, and may be formed to communicate the other side of the inclined space 734 with the second outlet 736*b*.

The valve plate lower surface 730*b* may be formed to be spaced apart from the fixed base plate upper surface 510*a*, so that the discharge valve 600 may be interposed between the fixed base plate upper surface 510*a* and the valve plate lower surface 730*b*, and the refrigerant discharged from the discharge hole 512 may flow into the discharge chamber D.

The first protrusion 732*a* may include a first large-diameter portion 732*aa* protruding from one side of the valve plate lower surface 730*b* toward the first injection hole 514*a*, and a first small-diameter portion 732*ab* more protruding from the first large-diameter portion 732*aa* toward the first injection hole 514*a*.

In the first large-diameter portion 732*aa*, an outer diameter of the first large-diameter portion 732*aa* may be larger than an inner diameter of the first small-diameter portion insertion groove 516*a*, so that the first large-diameter portion 732*aa* may not be inserted into the first small-diameter portion insertion groove 516*a*, and a third sealing member 760 to be described later may be compressed between an end surface of the first large-diameter portion 732*aa* and the fixed base plate upper surface 510*a*.

In the first small-diameter portion 732*ab*, an outer diameter of the first small-diameter portion 732*ab* may be smaller than the outer diameter of the first large-diameter portion 732*aa* and may be formed at the same level as the inner diameter of the first small-diameter portion insertion groove 516*a*, so that the first small-diameter portion 732*ab* may be inserted into the first small-diameter portion insertion groove 516*a*.

And, in the first small-diameter portion 732*ab*, a protrusion length of the first small-diameter portion 732*ab* (the axial distance between the end surface of the first large-diameter portion 732*aa* and an end surface of the first small-diameter portion 732*ab*) may be formed larger than a thickness before deformation of a third sealing member 760 to be described later, and may be formed to be less than or equal to sum of a thickness before deformation of a third sealing member 760 to be described later and the axial depth of the first small-diameter portion insertion groove 516*a*, so that the end surface of the first small-diameter portion 732*ab* may not be in contact with the base surface of the first small-diameter portion insertion groove 516*a*, and a gap between the end surface of the first large-diameter portion 732*aa* and the fixed base plate upper surface 510*a* may be smaller than or equal to a thickness before deformation (thickness before being compressed between the fixed base plate upper surface 510*a* and the end surface of the first large-diameter portion 732*aa*) of a third sealing member 760 to be described later, thus a third sealing member 760 to be described later may be compressed between the end surface of the first large-diameter portion 732*aa* and the fixed base plate upper surface 510*a*. Here, just in case the third sealing member 760, which will be described later, is not compressed between the end surface of the first large-diameter portion 732*aa* and the fixed base plate upper surface 510*a* due to tolerance, it may be desirable to design the protrusion length of the first small-diameter portion 732*ab* to be larger than a thickness before deformation of a third sealing member 760 to be described later and smaller than the sum of a thickness before deformation of a third sealing member 760 to be described later and the axial depth of the first small-diameter portion insertion groove 516*a*.

The second protrusion 732*b* may be formed similarly to the first protrusion 732*a*.

That is, the second protrusion 732*b* may include a second large-diameter portion 732*ba* protruding from the other side of the valve plate lower surface 730*b* toward the second injection hole 514*b*, and a second small-diameter portion 732*bb* more protruding from the second large-diameter portion 732*ba* toward the second injection hole 514*b*.

In the second large-diameter portion 732*ba*, an outer diameter of the second large-diameter portion 732*ba* may be larger than an inner diameter of the second small-diameter portion insertion groove 516*b*, so that the second large-diameter portion 732*ba* may not be inserted into the second small-diameter portion insertion groove 516*b*, and a third sealing member 760 to be described later may be compressed between an end surface of the second large-diameter portion 732*ba* and the fixed base plate upper surface 510*a*.

In the second small-diameter portion 732*bb*, an outer diameter of the second small-diameter portion 732*bb* may be smaller than the outer diameter of the second large-diameter portion 732*ba* and may be formed at the same level as the inner diameter of the second small-diameter portion insertion groove 516*b*, so that the second small-diameter portion 732*bb* may be inserted into the second small-diameter portion insertion groove 516*b*.

And, in the second small-diameter portion 732*bb*, a protrusion length of the second small-diameter portion 732*bb* (the axial distance between the end surface of the second large-diameter portion 732*ba* and an end surface of the second small-diameter portion 732*bb*) may be formed larger than a thickness before deformation of a third sealing member 760 to be described later, and may be formed to be less than or equal to sum of a thickness before deformation of a third sealing member 760 to be described later and the axial depth of the second small-diameter portion insertion groove 516*b*, so that the end surface of the second small-diameter portion 732*bb* may not be in contact with the base surface of the second small-diameter portion insertion groove 516*b*, and a gap between the end surface of the second large-diameter portion 732*ba* and the fixed base plate upper surface 510*a* may be smaller than or equal to a thickness before deformation (thickness before being compressed between the fixed base plate upper surface 510*a* and the end surface of the second large-diameter portion 732*ba*) of a third sealing member 760 to be described later, thus a third sealing member 760 to be described later may be compressed between the end surface of the second large-diameter portion 732*ba* and the fixed base plate upper surface 510*a*. Here, just in case the third sealing member 760, which will be described later, is not compressed between the end surface of the second large-diameter portion 732*ba* and the fixed base plate upper surface 510*a* due to tolerance, it may be desirable to design the protrusion length of the second small-diameter portion 732*bb* to be larger than a thickness before deformation of a third sealing member 760 to be described later and smaller than the sum of a thickness before deformation of a third sealing member 760 to be described later and the axial depth of the second small-diameter portion insertion groove 516*b*.

And, the valve plate 730 may further include a first fastening hole 739*a* formed through the valve plate 730 from the valve plate upper surface 730*a* to the valve plate lower surface 730*b* in the outer periphery of the valve plate 730, to be communicated with the second fastening hole 714, and to be penetrated by the fastening bolt 770.

In addition, the valve plate 730 may further include a second positioning groove 739*b* engraved from the valve plate upper surface 730*a*, to be communicated with the second positioning hole 726*a*, and so that the positioning pin 780 is inserted therein.

Here, the injection valve assembly 700 may be aligned by the positioning pin 780, the first positioning hole 716, the second positioning hole 726*a*, the first positioning groove 138*b*, and the second positioning groove 739*b*, and then may be fastened to the rear housing 130 by the fastening bolt 770, the first fastening hole 739*a*, the second fastening hole 714 and the fastening groove 138*a*. That is, one end of the positioning pin 780 passes through the first positioning hole 716 and is inserted into the first positioning groove 138*b*, and the other end of the positioning pin 780 passes through the second positioning hole 726*a* and is inserted into the second positioning groove 739*b*, so that the cover plate 710, the injection valve 720, and the valve plate 730 may be arranged at predetermined positions. Then, the fastening bolt 770 passes through the first fastening hole 739*a* and the second fastening hole 714 and is fastened to the fastening groove 138*a*, so that the injection valve assembly 700 may be fastened to the rear housing 130.

Meanwhile, as shown in FIGS. 2 to 4 and 8, when the injection valve assembly 700 is coupled to the rear housing 130, a first sealing member 740 may be interposed between the cover plate upper surface 710*a* and the third annular wall 138, and a second sealing member 750 may be interposed between the valve plate upper surface 730*a* and the cover plate lower surface 710*b*.

And, as shown in FIGS. 2 to 4 and 12, when the injection valve assembly 700 is fastened to the fixed scroll 500, a third sealing member 760 may be interposed between the end surfaces of the large-diameter portions 732*aa*, 732*ba* and the fixed base plate upper surface 510*a*.

Here, in the third sealing member 760, as described above, a thickness before deformation of the third sealing member 760 may be greater than or equal to the gap between the end surfaces of the large-diameter portions 732*aa*, 732*ba* and the fixed base plate upper surface 510*a*, so that the third sealing member 760 may be compressed between the end surfaces of the large-diameter portions 732*aa*, 732*ba* and the fixed base plate upper surface 510*a*.

Meanwhile, unexplained reference numerals 718 and 719 denote a first groove 718 and second groove 719 formed in the cover plate 710, and unexplained reference numerals 518 and 519 denote a third groove 518 and fourth groove 519 formed in the fixed base plate 510.

The first groove 718 is for reducing a contact area between the head 722 of the injection valve 720 and the cover plate 710 to reduce collision noise between the head 722 of the injection valve 720 and the cover plate 710, and is for preventing foreign substances from being caught between the head 722 of the injection valve 720 and the cover plate 710 by collecting and discharging foreign substances, and may be formed in an annular shape surrounding the periphery of the inlet 712 while being engraved from the injection valve seating groove 710*c*, as shown in FIG. 10. And, an inner periphery of the first groove 718 may be formed to overlap an outer periphery of the head 722 of the injection valve 720 in the axial direction, and an outer periphery of the first groove 718 may be formed to not overlap the head 722 of the injection valve 720 in the axial direction. That is, an inner diameter of the first groove 718 may be smaller than an outer diameter of the head 722 of the injection valve 720, and an outer diameter of the first groove 718 may be formed larger than an outer diameter of the head 722 of the injection valve 720. Here, the reason that the outer diameter of the first groove 718 is larger than the outer diameter of the head 722 of the injection valve 720 is to allow foreign substances collected in the first groove 718 to be discharged to the inclined space 734.

The second groove 719 is for collecting and discharging foreign substances to prevent foreign substances from being caught between the leg 724 of the injection valve 720 and the cover plate 710, and may be formed to be engraved from the injection valve seating groove 710*c* at a position opposite to the leg 724 of injection valve 720, as shown in FIG. 10. In addition, the second groove 719 is formed in a long hole shape, a center of the second groove 719 is formed to overlap with the leg 724 of the injection valve 720 in the axial direction, and both ends of the second groove 719 may be formed to be non-overlapping with the leg 724 of the injection valve 720 in the axial direction. That is, a long axis direction of the second groove 719 and a width direction of the leg 724 of the injection valve 720 may be parallel to each other, and a long axis length of the second groove 719 may be formed to be greater than a width of the leg 724 of the injection valve 720. Here, the long axis length of the second groove 719 is formed to be greater than the width of the leg 724 of the injection valve 720 in order to allow foreign substances collected in the second groove 719 to be discharged into the inclined space 734.

Similar to the first groove 718, the third groove 518 is for reducing a contact area between the main opening/closing portion 610 of the discharge valve 600 and the fixed base plate 510 to reduce collision noise between the main opening/closing portion 610 of the discharge valve 600 and the fixed base plate 510, and is for preventing foreign substances from being caught between the main opening/closing portion 610 of the discharge valve 600 and the fixed base plate 510 by collecting and discharging foreign substances, and may be formed in an annular shape surrounding the main discharge hole 512*a* while being engraved from the fixed base plate upper surface 510*a*, as shown in FIGS. 8 and 13. And, an inner periphery of the third groove 518 may be formed to overlap an outer periphery of the opening/closing portion of the discharge valve 600 in the axial direction, and an outer periphery of the third groove 518 may be formed to not overlap the opening/closing portion of the discharge valve 600 in the axial direction. That is, an inner diameter of the third groove 518 may be smaller than an outer diameter of the opening/closing portion of the discharge valve 600, and an outer diameter of the third groove 518 may be greater than an outer diameter of the opening/closing portion of the discharge valve 600. Here, the reason that the outer diameter of the third groove 518 is larger than the outer diameter of the opening/closing portion of the discharge valve 600 is to allow foreign substances collected in the third groove 518 to be discharged to the discharge chamber D.

Similar to the second groove 719, the fourth groove 519 is for collecting and discharging foreign substances to prevent foreign substances from being caught between the main supporting portion 620, the first sub supporting portion 640, and the second sub supporting portion 660 (hereinafter, the supporting portion) of the discharge valve 600 and the fixed base plate 510, may be formed to be engraved from the fixed base plate upper surface 510*a* at a position opposite to the supporting portion of the discharge valve 600, as shown in FIGS. 8 and 13. In addition, the fourth groove 519 is formed in a long hole shape, a central portion of the fourth groove 519 is formed to overlap with the supporting portion of the discharge valve 600 in an axial direction, and both ends of the fourth groove 519 may be formed to be non-overlapping the supporting portion of the discharge valve 600 in the axial direction. That is, a long axis direction of the fourth groove 519 and a width direction of the supporting portion of the discharge valve 600 may be parallel to each other, and a long axis length of the fourth groove 519 may be greater than a width of the supporting portion of the discharge valve 600. Here, the long axis length of the fourth groove 519 is formed to be greater than the width of the supporting portion of the discharge valve 600 in order to allow foreign substances collected in the fourth groove 519 to be discharged into the discharge chamber D.

Hereinafter, effects of the scroll compressor according to the present embodiment will be described.

That is, when power is applied to the motor 200, the rotating shaft 300 may rotate together with the rotor 220.

And, the orbital scroll 400 may be orbital moved by receiving the rotational force from the rotating shaft 300 through the eccentric bush 310.

Accordingly, the volume of the compression chamber C may be reduced while continuously moving toward the center side.

In addition, the refrigerant having a suction pressure may be introduced into the compression chamber C through the suction port (not illustrated), the motor accommodating space S1, the suction flow path (not illustrated), and the scroll accommodating space S2.

In addition, the refrigerant sucked into the compression chamber C may be compressed while moving toward the center along a movement path of the compression chamber C and discharged to the discharge chamber D through the discharge hole 512.

In addition, the refrigerant of the discharge pressure discharged to the discharge chamber D may be discharged to the outside of the compressor through the discharge port 131.

Here, the scroll compressor according to this embodiment includes the injection flow path (introduction port 133, introduction chamber I, injection valve assembly 700, injection hole 514) for guiding the intermediate pressure refrigerant to the compression chamber C, and compresses and discharges the refrigerant of suction pressure as well as the intermediate pressure refrigerant, so that the refrigerant discharge amount may be increased than when only the refrigerant of suction pressure is sucked, compressed and discharged. Thereby, the performance and efficiency of the compressor may be improved.

And, without having a separate housing, as the rear housing 130 includes the discharge chamber D and the discharge port 131 as well as the introduction port 133 and the introduction chamber I, that is, as the rear housing 130 having the discharge chamber D, the discharge port 131, the introduction port 133 and the introduction chamber I is integrally formed, the possibility of leakage is reduced, and the size, cost and weight may be reduced.

And, as at least a portion of the introduction chamber I is accommodated in the discharge chamber D, that is, as the side of the introduction chamber I overlaps the discharge chamber D with the third annular wall 138 interposed therebetween, and as the end of the introduction chamber I is overlapped the discharge chamber D with the injection valve assembly 700 interposed therebetween, the refrigerant guided to the injection hole 514 may exchange heat with the refrigerant of the discharge chamber D through the third annular wall 138 and the injection valve assembly 700. That is, the refrigerant of the introduction chamber I and the refrigerant passing through the injection valve assembly 700 may be heated by receiving heat from the refrigerant of the discharge chamber D. Accordingly, it is possible to prevent a liquid refrigerant from being injected into the compression chamber C through the injection hole 514.

And, as at least a portion of the discharge port 131 is accommodated in the introduction chamber I, that is, as at least a portion of the discharge port 131 overlaps the introduction chamber I with the wall portion of the discharge port 131 interposed therebetween, the refrigerant of the introduction chamber I may exchange heat with the refrigerant of the discharge port 131 through the wall portion of the discharge port 131 accommodated in the introduction chamber I. That is, the refrigerant of the introduction chamber I may be heated by receiving heat from the refrigerant of the discharge port 131. Thereby, it is possible to further prevent the liquid refrigerant from being injected into the compression chamber C through the injection hole 514.

And, as at least a portion of the introduction port 133 is accommodated in the discharge chamber D, that is, as at least a portion of the introduction port 133 overlaps the discharge chamber D with the wall portion of the introduction port 133 interposed therebetween, the refrigerant of the introduction port 133 may exchange heat with the refrigerant of the discharge chamber D through the wall portion of the introduction port 133 accommodated in the discharge chamber D. That is, the refrigerant of the introduction port 133 may be heated by receiving heat from the refrigerant of the discharge chamber D. Thereby, it is possible to further prevent the liquid refrigerant from being injected into the compression chamber C through the injection hole 514.

And, as the refrigerant of the discharge port 131 and the refrigerant of the introduction port 133 flow in a cross-flow direction with each other, that is, as the angle between the outlet of the discharge port 131 and the inlet of the introduction port 133 with respect to the center of the rear housing 130 is formed at 0 degrees or more and less than 90 degrees, the refrigerant of the introduction port 133 may exchange heat with the refrigerant of the discharge port 131. That is, the refrigerant of the introduction port 133 may be heated by receiving heat from the refrigerant of the discharge port 131. Thereby, injection of the liquid refrigerant into the compression chamber C through the injection hole 514 may be more effectively prevented.

And, the injection valve assembly 700 includes the cover plate 710, the injection valve 720 and the valve plate 730, and the valve plate 730 not only forms a part of the injection flow path but also serves as a retainer of the injection valve 720, that is, the valve plate 730 includes the inclined space 734, so that the number of parts, size, cost, and weight of the injection valve assembly 700 may be reduced.

And, as the injection valve 720 is formed in such a way that the periphery 726 of the injection valve 720 is pressed and fixed between the cover plate 710 (more precisely, the injection valve seating groove 710*c*) and the valve plate 730, a fastening member for fastening the injection valve 720 to at least one of the cover plate 710 and the valve plate 730 may be deleted. Thereby, the number of parts, size, cost and weight of the injection valve assembly 700 may be further reduced.

And, as the injection valve assembly 700 is formed to be fastened to the rear housing 130 at once by the fastening bolt 770 after being pre-aligned by the positioning pin 780, assembling property and assembly quality may be improved.

And, as the injection hole 514 is formed to communicate with the pair of compression chamber C at the same time, that is, as the communication between the second injection hole 514*b* and the first inner compression chamber C12 start when the communication between the first injection hole 514*a* and the first outer compression chamber C11 starts, the pressure imbalance between the first outer compression chamber C11 and the first inner compression chamber C12 may be suppressed, and abnormal behavior (e.g., overturning) of the orbital scroll 400 may be suppressed.

And, additionally, as the injection hole 514 is formed to be blocked simultaneously with the pair of compression chamber C, that is, as the communication between the second injection hole 514*b* and the first inner compression chamber C12 is terminated when the communication between the first injection hole 514*a* and the first outer compression chamber C11 is terminated, the pressure imbalance between the first outer compression chamber C11 and the first inner compression chamber C12 may be further suppressed, and the abnormal behavior (e.g., overturning) of the orbital scroll 400 may be further suppressed.

Here, the timing at which the injection hole 514 communicates with the pair of compression chamber C and the timing at which the injection hole 514 is simultaneously blocked with the pair of compression chamber C may be appropriately adjusted in consideration of the performance and efficiency of the scroll compressor.

On the other hand, in this embodiment, the injection valve assembly 700 is formed to branch the refrigerant flowing in from the introduction chamber I in the inclined space 734 to guide the first injection hole 514*a* and the second injection hole 514*b*. That is, the inlet 712, the head 722 of the injection valve 720, the leg 724 of the injection valve 720, and the inclined space 734 are each formed as one, and the connection flow path 738 and the outlet 736 are formed in two, respectively.

However, in this embodiment, the flow rate of the refrigerant distributed to the first injection hole 514*a* and the second injection hole 514*b* may be different from each other. In particular, when the first connection flow path 738*a* and the first outlet 736*a* are asymmetrically formed with the second connection flow path 738*b* and the second outlet 736*b*, the flow rate of the refrigerant distributed to the first injection hole 514*a* and the second injection hole 514*b* may become more non-uniform by the flow resistance difference.

In consideration of this, as shown in FIGS. 21 to 24, an injection valve assembly 700 may be formed to guide a refrigerant flowing in from one side of an introduction chamber I to a first injection hole 514*a*, and may be formed to independently guide a refrigerant flowing in from the other side of the introduction chamber I to a second injection hole 514*b*.

Specifically, the inlet 712 may include a first inlet 712*a* that communicates with one side of the introduction chamber I, and a second inlet 712*b* formed independently of the first inlet 712*a* and communicating with the other side of the introduction chamber I.

Here, it may be preferable that the first inlet 712*a* and the second inlet 712*b* be formed into long holes for maximizing a valve lifting force and a refrigerant inlet flow rate, respectively.

And, the injection valve 720 may include a first head 722*a* opening and closing the first inlet 712*a*, a first leg 724*a* supporting the first head 722*a*, a second head 722*b* opening and closing the second inlet 712*b*, a second leg 724*b* supporting the second head 722*b*, and a periphery 726 supporting the first leg 724*a* and the second leg 724*b*.

Here, the first head 722*a*, the first leg 724*a*, the second head 722*b*, the second leg 724*b*, and the periphery 726 may be integrally formed to reduce the number of parts, size, cost, and weight.

In addition, it may be more preferable in terms of compactness that the first leg 724*a* and the second leg 724*b* are formed parallel to each other, and a connection portion between the first leg 724*a* and the periphery 726 and a connection portion between the second leg 724*b* and the periphery 726 are formed on opposite sides to each other. That is, it may be more preferable that the first leg 724*a* and the second leg 724*b* are alternately formed.

The inclined space 734 may include a first inclined space 734*a* serving as a retainer of the first head 722*a* and receiving refrigerant flowing through the first inlet 712*a*, and a second inclined space 734*b* serving as a retainer of the second head 722*b* and receiving the refrigerant flowing in through the second inlet 712*b*.

Here, it may be preferable that the first inclined space 734*a* and the second inclined space 734*b* are separated from each other, and may be preferable that a retainer surface of the first inclined space 734*a* and a retainer surface of the second inclined space 734*b* be inclined in alternating directions to correspond to the first leg 724*a* and the second leg 724*b*.

An outlet 736 may include a first outlet 736*a* communicating with the first injection hole 514*a* and a second outlet 736*b* communicating with the second injection hole 514*b*, and a connection flow path 738 may include a first connection flow path 738*a* connecting the first inclined space 734*a* and the first outlet 736*a* and a second connection flow path 738*b* connecting the second inclined space 734*b* and the second outlet 736*b*.

Here, in the connection flow path 738 and the outlet 736, an inner diameter of the first connection flow path 738*a* may be formed to be larger than an inner diameter of the first outlet 736*a*, and an inner diameter of the second connection flow path 738*b* may be formed to be larger than an inner diameter of the second outlet 736*b*, so that pressure loss and flow rate loss do not occur while the refrigerant passes through the connection flow path 738 and the outlet 736.

In the case of another embodiment of the present disclosure, as the refrigerant of the introduction chamber I is independently guided to the first injection hole 514*a* and the second injection hole 514*b*, the refrigerant is distributed to the first injection hole 514*a* and the second injection hole 514*b* may be equalized to each other.

The invention claimed is:

1. A scroll compressor comprising:

a housing;

a motor provided in the housing;

a rotating shaft rotated by the motor;

an orbital scroll orbitally moved by the rotating shaft; and a fixed scroll forming a compression chamber together with the orbital scroll, wherein the fixed scroll comprises an injection hole guiding an intermediate pressure refrigerant to the compression chamber, wherein the compression chamber is formed in a pair of compression chambers, and wherein the injection hole is formed to communicate with a first one of the pair of compression chambers when communicating with a second one of the pair of compression chambers, wherein the injection hole is formed to be blocked from one of the pair of compression chambers when blocked from an other one of the pair of compression chambers, and wherein the compression chamber comprises a first compression chamber having a first pressure, a second compression chamber having a second pressure higher than the first pressure, and a third compression chamber having a third pressure higher than the second pressure.

2. A scroll compressor comprising:

a housing;

a motor provided in the housing;

a rotating shaft rotated by the motor;

an orbital scroll orbitally moved by the rotating shaft; and a fixed scroll forming a compression chamber together with the orbital scroll, wherein the fixed scroll comprises an injection hole guiding an intermediate pressure refrigerant to the compression chamber, wherein the compression chamber is formed in a pair of compression chambers, and wherein the injection hole is formed to communicate with a first one of the pair of compression chambers when communicating with a second one of the pair of compression chambers;

an injection flow path guiding intermediate pressure refrigerant from an outside of the housing to the injection hole; and an injection valve assembly opening and closing the injection flow path, wherein the injection valve assembly comprises a protrusion protruding toward the fixed scroll, and wherein an outlet communicating with the injection hole is formed on the protrusion.

3. The scroll compressor of claim 2, wherein the protrusion comprises a large-diameter portion protruding from the injection valve assembly toward the fixed scroll and having a predetermined first outer diameter, and a small-diameter portion protruding further from the large-diameter portion toward the fixed scroll and having a second outer diameter smaller than the first outer diameter.

4. The scroll compressor of claim 3, wherein the fixed scroll comprises a fixed base plate upper surface opposite to the large-diameter portion, a fixed base plate lower surface forming a rear surface of the fixed base plate upper surface, a small-diameter portion insertion groove formed to be engraved from the fixed base plate upper surface toward the fixed base plate lower surface and into which the small-diameter portion is inserted, and the injection hole formed to be engraved from the fixed base plate lower surface toward the fixed base plate upper surface and communicated with the small-diameter portion insertion groove.

5. The scroll compressor of claim 4, wherein an inner diameter of the small-diameter portion insertion groove is larger than an inner diameter of the injection hole.

6. The scroll compressor of claim 1, wherein the first compression chamber comprises a first outer compression chamber formed by an outer circumferential surface of an orbiting wrap of the orbital scroll and an inner circumferential surface of a fixed wrap of the fixed scroll, and a first inner compression chamber formed by an inner circumferential surface of the orbiting wrap and an outer circumferential surface of the fixed wrap, wherein the second compression chamber comprises a second outer compression chamber formed by the outer circumferential surface of the orbiting wrap and the inner circumferential surface of the fixed wrap, and a second inner compression chamber formed by the inner circumferential surface of the orbiting wrap and the outer circumferential surface of the fixed wrap, and wherein the third compression chamber comprises a third outer compression chamber formed by the outer circumferential surface of the orbiting wrap and the inner circumferential surface of the fixed wrap, and a third inner compression chamber formed by the inner circumferential surface of the orbiting wrap and the outer circumferential surface of the fixed wrap.

7. The scroll compressor of claim 6, wherein the injection hole comprises a first injection hole communicating with the first outer compression chamber, and a second injection hole communicating with the first inner compression chamber, and wherein communication between the second injection hole and the first inner compression chamber is initiated when communication between the first injection hole and the first outer compression chamber is initiated, and the communication between the second injection hole and the first inner compression chamber is terminated when the communication between the first injection hole and the first outer compression chamber is terminated.

8. The scroll compressor of claim 7, wherein the fixed scroll comprises a main discharge hole discharging the refrigerant of the third compression chamber, and a sub discharge hole discharging the refrigerant of the second compression chamber, wherein the sub discharge hole comprises a first sub discharge hole discharging the refrigerant of the second outer compression chamber, and a second sub discharge hole discharging the refrigerant of the second inner compression chamber, and wherein communication between the second sub discharge hole and the second inner compression chamber is initiated when communication between the first sub discharge hole and the second outer compression chamber is initiated, and the communication between the second sub discharge hole and the second inner compression chamber is terminated when the communication between the first sub discharge hole and the second outer compression chamber is terminated.

9. The scroll compressor of claim 8, wherein the first sub discharge hole and the second sub discharge hole are formed on opposite sides with respect to the main discharge hole, and wherein the first injection hole and the second injection hole are formed on opposite sides with respect to an imaginary line connecting the first sub discharge hole and the second sub discharge hole.

10. A scroll compressor comprising a housing;

a motor provided in the housing;

a rotating shaft rotated by the motor;

an orbital scroll orbital moved by the rotating shaft; and a fixed scroll forming a pair of compression chambers with the orbital scroll, wherein the fixed scroll comprises an injection hole guiding intermediate pressure refrigerant into the pair of compression chambers, a main discharge hole discharging the refrigerant compressed in the pair of compression chambers, a first sub discharge hole discharging the refrigerant overcompressed in a first one of the pair of compression chambers, and a second sub discharge hole discharging the refrigerant overcompressed in a second one of the pair of compression chambers, and wherein a discharge valve comprising a main opening/closing portion opening and closing the main discharge hole, a first sub opening/closing portion opening and closing the first sub discharge hole, a second sub opening/closing portion opening and closing the second sub discharge hole, a fastening portion fastened to the fixed scroll, a main supporting portion extending from the main opening/closing portion to the fastening portion, a first sub supporting portion extending from the first sub opening/closing portion to the fastening portion, and a second sub supporting portion extending from the second sub opening/closing portion to the fastening portion is formed in the fixed scroll, wherein at least one of the first sub supporting portion and the second sub supporting portion comprises an avoidance portion engraved toward the main supporting portion so as not to interfere with the injection hole.

11. The scroll compressor of claim 10, wherein a width of the fastening portion is formed to be smaller than a distance between the first sub opening/closing portion and the second sub opening/closing portion.

12. The scroll compressor of claim 10, wherein the fixed scroll comprises a fixed wrap entry connected to a fixed wrap of the fixed scroll on an outer periphery of the fixed scroll, and wherein a fastening member fastening the fastening portion to the fixed scroll is fastened to the fixed wrap entry.

* * * * *